US009627799B2

(12) United States Patent
Tseng et al.

(10) Patent No.: US 9,627,799 B2
(45) Date of Patent: Apr. 18, 2017

(54) CABLE CONNECTOR

(71) Applicant: Molex, LLC, Lisle, IL (US)

(72) Inventors: Ting Chang Tseng, Taipei (TW); Yao Ting Wang, Taipei (TW)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/202,283

(22) Filed: Jul. 5, 2016

(65) Prior Publication Data

US 2017/0012386 A1 Jan. 12, 2017

(30) Foreign Application Priority Data

Jul. 9, 2015 (TW) ..... 104122358 A

(51) Int. Cl.
*H01R 13/52* (2006.01)
*H01R 13/58* (2006.01)

(52) U.S. Cl.
CPC ..... *H01R 13/5825* (2013.01)

(58) Field of Classification Search
CPC ..... H01R 13/5825; H01R 13/521; H01R 13/5219; H01R 13/5216
See application file for complete search history.

(56) References Cited

U.S. PATENT DOCUMENTS 3,271,726 A * 9/1966 Pfendler ..... H01R 23/27 29/830
7,331,824 B2 2/2008 Lin
7,497,724 B1 * 3/2009 Fong ..... H01R 4/023 439/497
7,952,027 B2 5/2011 Grelck
8,277,245 B2 10/2012 Fix et al.
8,556,648 B2 * 10/2013 Wu ..... H01R 13/5213 439/276
2009/0197451 A1 * 8/2009 Cox ..... H01R 4/2433 439/276
2012/0015551 A1 * 1/2012 Tobey ..... H01R 9/035 439/460
2012/0071015 A1 * 3/2012 Debock ..... H01R 12/775 439/271
2013/0029518 A1 * 1/2013 Truemper ..... H01R 4/2433 439/404
2013/0231011 A1 * 9/2013 Sytsma ..... H01R 9/034 439/723
2014/0154928 A1 * 6/2014 Nonen ..... H01R 4/04 439/660

* cited by examiner

*Primary Examiner* — Briggitte R Hammond
(74) *Attorney, Agent, or Firm* — Stephen L. Sheldon

(57) ABSTRACT

A cable connector comprises a mating board, a plurality of cables, an organizer and a binding material. The mating board comprises a board body and a plurality of conductive portions provided on the board body. The cables are respectively electrically connected to the conductive portions. The organizer comprises an upper cap, a lower cap and a spacer interposed between the upper cap and the lower cap. The upper cap, the lower cap and the spacer cooperatively define a filling space that includes upper cable passages and lower cable passages respectively extending along the front-rear direction and respectively receiving the cables so as to allow the plurality of cables to pass through the filling space. The binding material is filled in the filling space of the organizer and fixes the plurality of cables to the organizer.

29 Claims, 42 Drawing Sheets

CABLE CONNECTOR

RELATED APPLICATIONS

This application claims priority to Taiwanese Application No. 104122358, filed Jul. 9, 2015, which is incorporated herein by reference in its entirety.

TECHNICAL FIELD

The present disclosure relates to a connector, and particularly relates to a cable connector.

BACKGROUND ART

U.S. Pat. No. 7,952,027 discloses a cable management system which mainly comprises a cable management device for managing a plurality of cables, the cable management device comprises a stationary member, an upper movable member and a lower movable member, the upper movable member and the stationary member cooperate with each other to define a plurality of upper row through holes to allow the cables to pass through, and the lower movable member and the stationary member cooperate with each other to define a plurality of lower row through holes to allow the cables to pass through. However, the cable management device only has the function of combing the cables, there is not fixation relationship between the cable management device and the cables.

In addition, U.S. Pat. No. 7,331,824 (corresponding Chinese patent application No. CN200720139215.7 and corresponding Taiwanese patent M333692) discloses a cable connector assembly in which a spacer comprising a plurality of cable receiving cavities, a plurality of rectangular windows communicated with the cable receiving cavities and a plurality of fixing devices respectively provided in the rectangular windows and used to position the cables in the cable receiving cavities. However, one spacer only can fix a row of cables, therefore, if two rows of cables are fixed at the same time, two spacers will be required and then the two spacers are engaged with each other, so the material cost will be increased. Moreover, the spacer is an integral structure, but the cable receiving cavities are holes separated from each other. As a results, during assembly the cables must be inserted into the cable receiving cavities one by one, and then the cables soldered to the board. As can be appreciated, the spacer will hinder soldering operation. In addition, a binding material used to help fix the location of the component but it is necessary to add the binding material via the rectangular windows so that the operation is more complicated and time/labor intensive than desired, thus noticeably increasing the manufacturing cost.

SUMMARY OF THE INVENTION

A cable connector comprises at least one mating board, a plurality of cables, at least one organizer and a binding material. The mating board comprises a board body and a plurality of conductive portions provided to the board body, and the board body has a front edge and a rear edge. The plurality of cables are respectively electrically connected to the conductive portions of the mating board and extend from a rear edge of the board body. The organizer comprises an upper cap, a lower cap and a spacer interposed between the upper cap and the lower cap. The upper cap, the lower cap and the spacer each are frame-shaped and each have a front frame portion, a rear frame portion spaced apart from and opposite to the front frame portion, and a first side frame portion and a second side frame portion each connecting the front frame portion and the rear frame portion and spaced apart from each other and opposite to each other, and the upper cap, the lower cap and the spacer cooperatively define a filling space, the spacer and the upper cap cooperatively define a plurality of upper cable passages respectively extending along a front-rear direction and respectively receiving the cables and the spacer and the lower cap cooperatively define a plurality of lower cable passages respectively extending along the front-rear direction and respectively receiving the cables, so as to allow the plurality of cables to pass through the filling space. The binding material is filled in the filling space of the organizer and fixes the plurality of cables to the organizer.

BRIEF DESCRIPTION OF THE DRAWINGS

The present invention is illustrated by way of example and not limited in the accompanying figures in which like reference numerals indicate similar elements and in which.

DETAILED DESCRIPTION OF THE PREFERRED EMBODIMENTS

Embodiments disclose a cable connector which can be used to interpose cables after the cables have a soldering operation performed and in which only a binding material is filled one time to fix the cables to an organizer, is simple in assembling and saves in time and labor. One benefit is that the spacer and the upper cap of the organizer cooperatively define the plurality of upper cable passages extending respectively along the front-rear direction for receiving the cables and the spacer and the lower cap of the organizer cooperatively define the plurality of lower cable passage extending respectively along the front-rear direction for receiving the cables, and by the spacer which are separated from the upper cap and the lower cap, the organizer can interpose the cables after the cables have been performed on soldering operation. Next, after the cables pass through the filling space, further by that the binding material is filled in the filling space of the organizer. Because the filling space penetrates along the vertical direction, the binding material can be used to fill the space at one time. The result is that the cables can be fixed to the organizer and the assembly process can be simpler and more time/labor effective.

Figure 1:
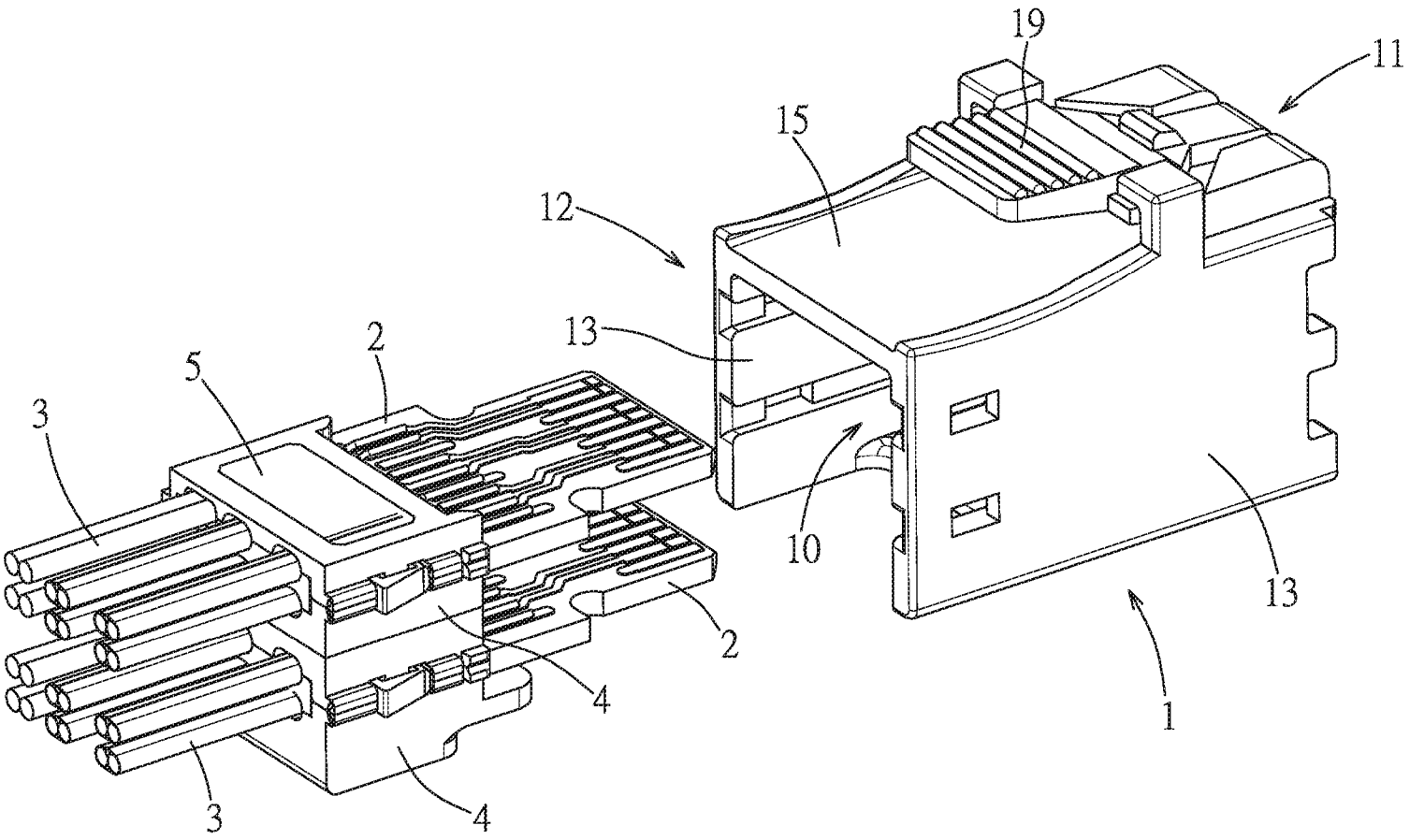
FIG. 1 is an exploded perspective view illustrating a first embodiment of a cable connector.
Figure 2:
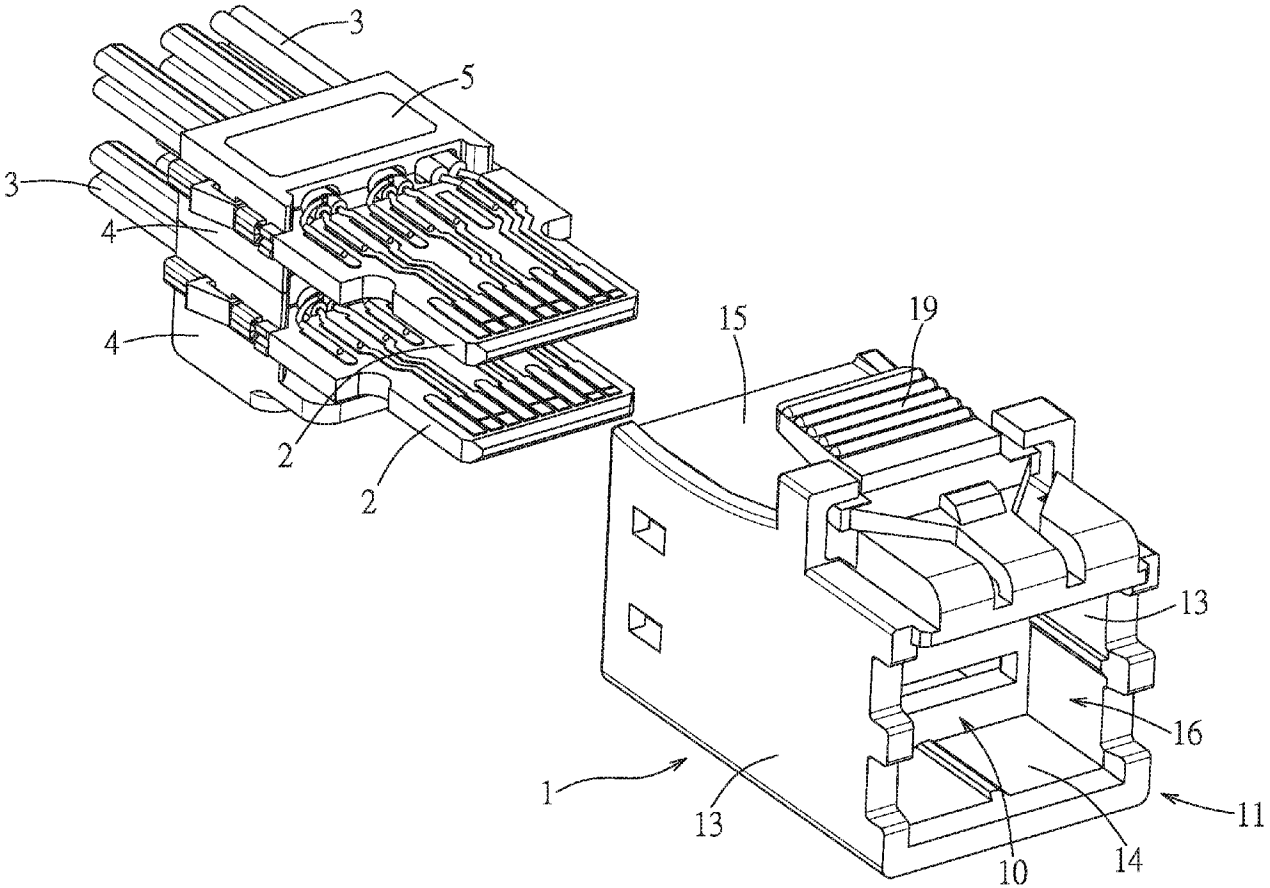
FIG. 2 is an exploded perspective view illustrating the first embodiment viewed from another angle.

Referring to FIG. 1 and FIG. 2, a first embodiment of a cable connector comprises a housing 1, two mating boards 2, a plurality of cables 3, two organizers 4 and a binding material 5.

Figure 3:
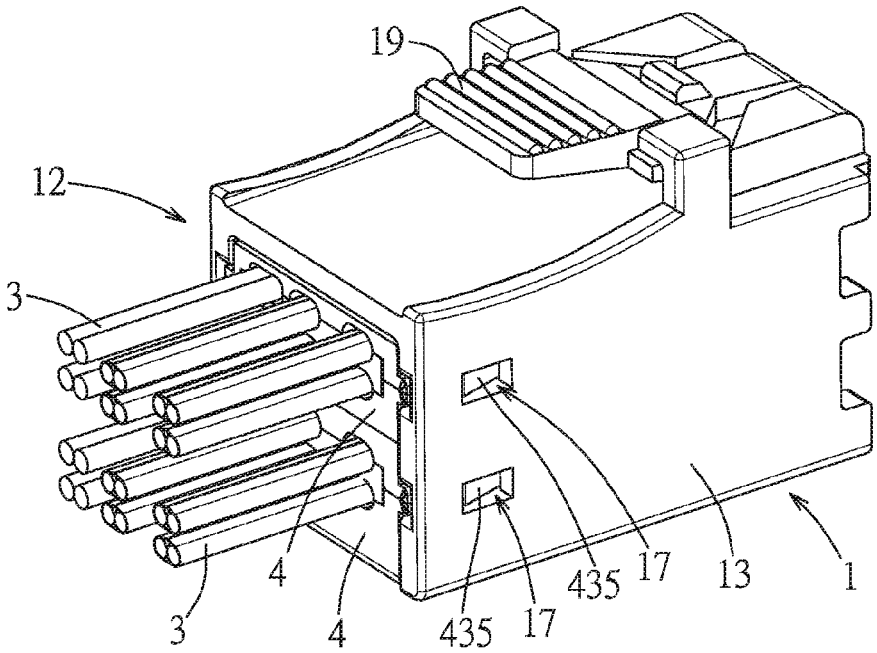
FIG. 3 is a perspective view illustrating the first embodiment under an assembled state.
Figure 4:
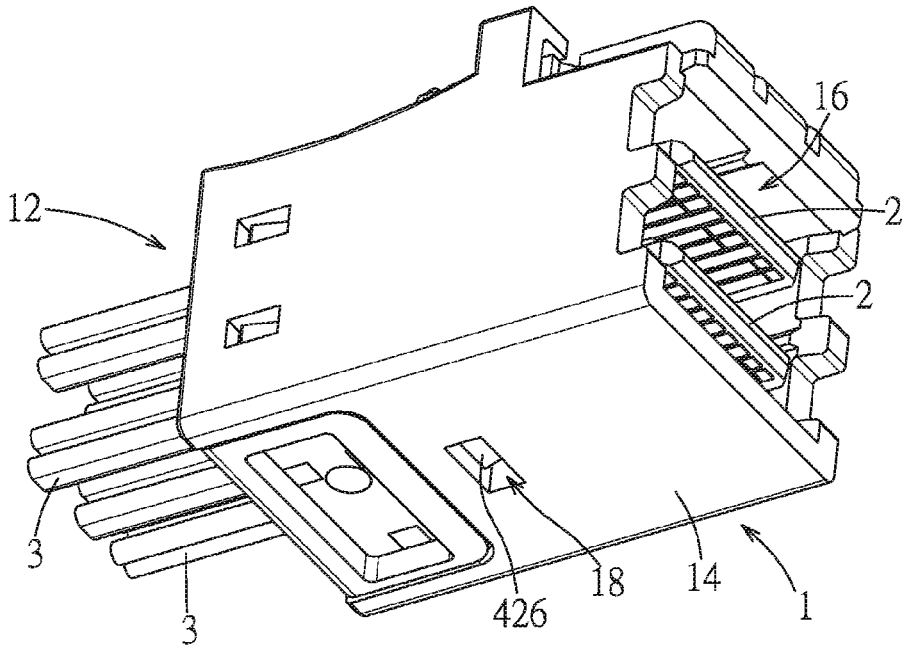
FIG. 4 is a perspective view illustrating the first embodiment under the assembled state and viewed from another angle.

The housing 1 is made of an insulative material, and has a front side 11, a rear side 12, two side walls 13, a bottom wall 14, a top wall 15, a mating port 16 and a locking portion 19. The two side walls 13, the bottom wall 14 and the top wall 15 cooperate with each other to define a receiving space 10. The mating port 16 is positioned at the front side 11 and is communicated with the receiving space 10. And the locking portion 19 is provided to the top wall 15 for locking a mating connector (not shown). In combination with referring to FIG. 3 and FIG. 4, the two mating boards 2 and the two organizers 4 are provided in the housing 1 and are received in the receiving space 10, and the cables 3 respectively extend through the rear side 12 of the housing 1 and extend outwardly. The mating connector (not shown) can be inserted into the mating port 16 and can be electrically connected to the two mating boards 2 in the housing la.

Figure 5:
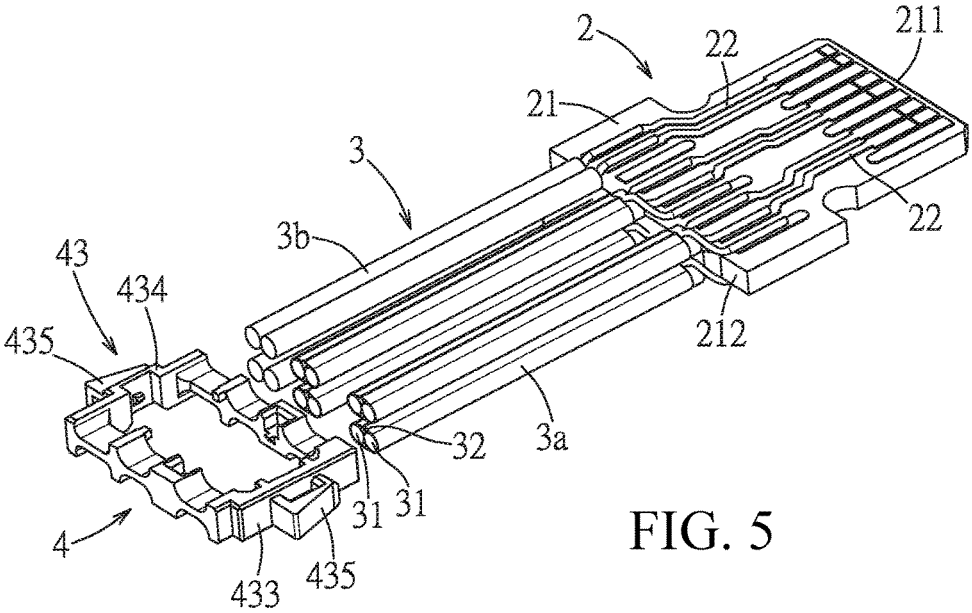
FIG. 5 is a perspective view illustrating that a plurality of cables of the first embodiment comprising a plurality of high frequency signal cable and a plurality of low frequency signal cable.
Figure 6:
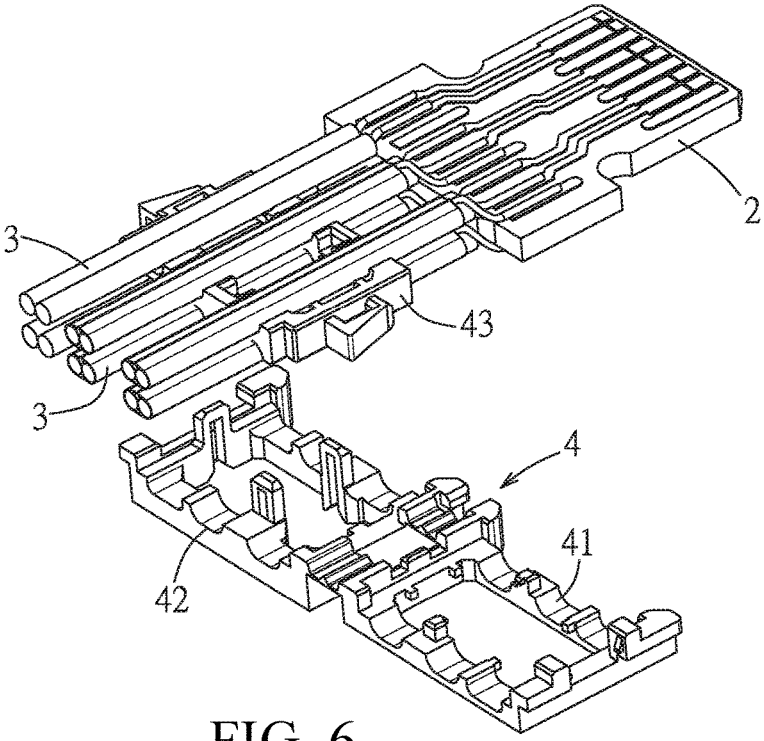
FIG. 6 is a perspective view illustrating that a spacer of an organizer of the first embodiment is inserted between the cables.
Figure 7:
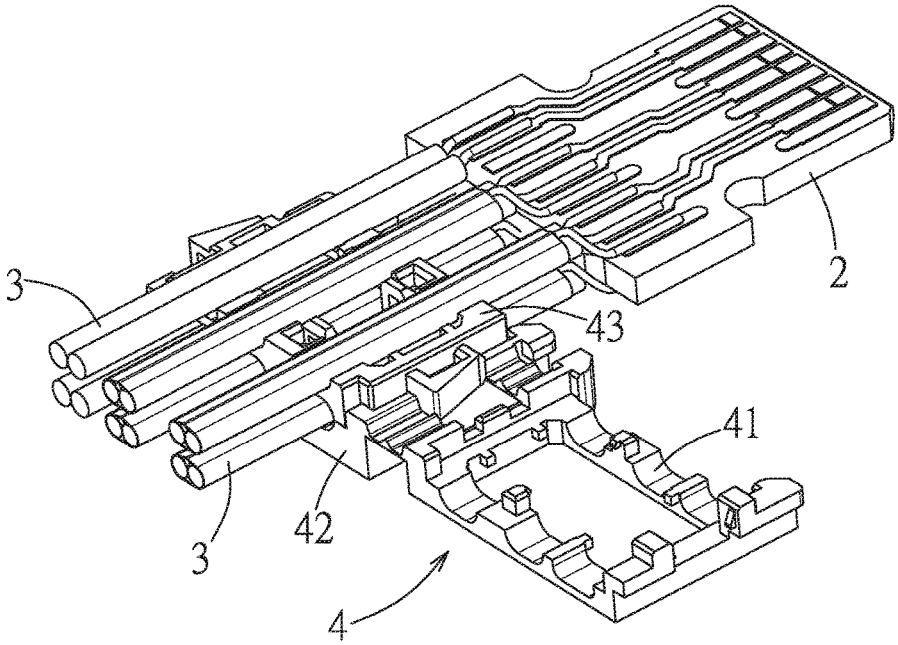
FIG. 7 is a perspective view illustrating an assembling process that the spacer of the organizer of the first embodiment is placed onto a lower cap.
Figure 8:
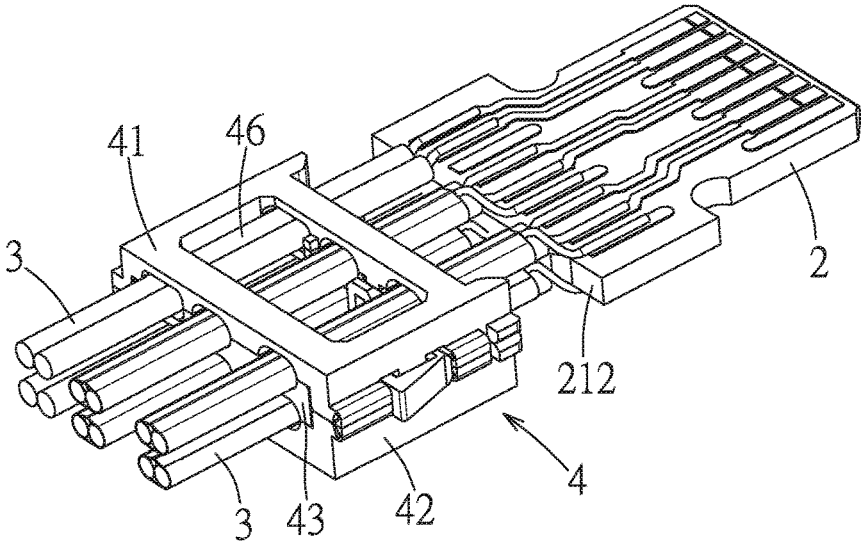
FIG. 8 is a perspective view illustrating that an upper cap of the organizer of the first embodiment cover the spacer, and the upper cap and the lower cap cooperatively interpose the spacer and the cables.

Referring to FIG. 5, each mating board 2 comprises a board body 21 and a plurality of conductive portions 22. The board body 21 has a front edge 211 and a rear edge 212, the conductive portions 22 are respectively provided on a top surface and a bottom surface of the board body 21. In an embodiment, each mating board 2 is a circuit board, and the conductive portions 22 are conductive traces on the board body 21 respectively.

The cables 3 are respectively electrically connected to the conductive portions 22 of the mating board 2 and extend from the rear edge 212 of the board body 21. In the first embodiment, the cables 3 comprises a plurality of high frequency signal cables 3a and a plurality of low frequency signal cables 3b, in which each high frequency signal cable 3a has two differential pair signal wires 31 and a ground wire 32 (see FIG. 18).

Figure 9:
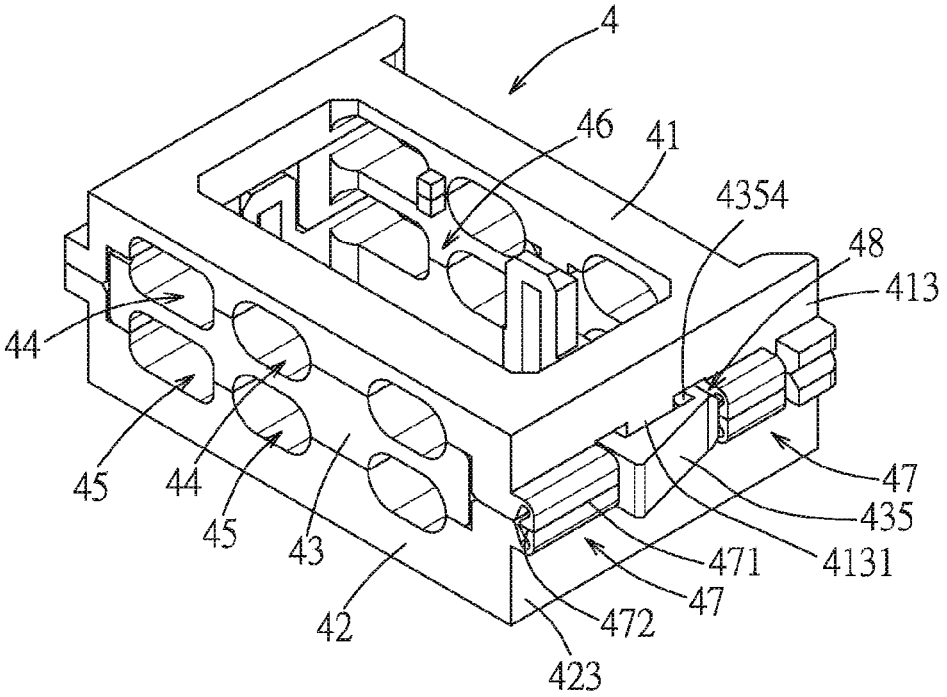
FIG. 9 is a perspective view illustrating that the upper cap, the lower cap and the spacer of the organizer of the first embodiment cooperate with each other to define a plurality of upper cable passages and a plurality of lower cable passages.
Figure 10:
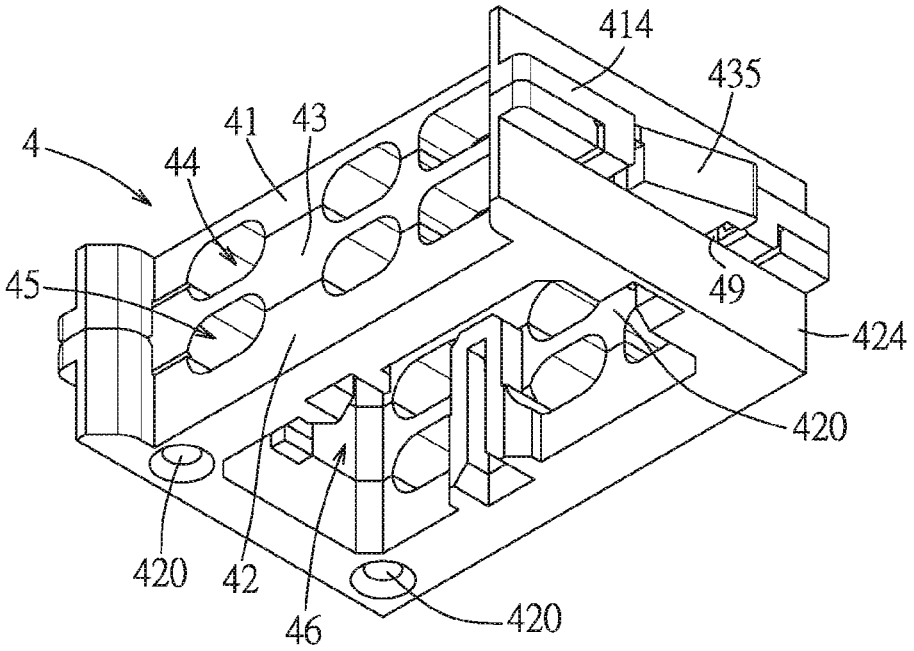
FIG. 10 is a perspective view illustrating the organizer of the first embodiment viewed from another angle.

Again referring to FIG. 1 and FIG. 2, the two organizers 4 are stacked along a vertical direction, and are substantially identical in main structure, so that the organizer 4 positioned above is firstly described. Referring to FIG. 6 to FIG. 9, the organizer 4 comprises an upper cap 41, a lower cap 42 and a spacer 43. The spacer 43 is interposed between the upper cap 41 and the lower cap 42, accordingly, the spacer 43 and the upper cap 41 cooperatively define a plurality of upper cable passages 44, and the spacer 43 and the lower cap 42 cooperatively define a plurality of lower cable passages 45 (as shown in FIG. 9), the upper cable passages 44 and the lower cable passages 45 respectively extend along a front-rear direction and are used to receive the cables 3 therein respectively. Specifically, referring to FIG. 9 to FIG. 11, the upper cap 41, the lower cap 42 and the spacer 43 each are frame-shaped, the upper cap 41 has a front frame portion 411, a rear frame portion 412, a first side frame portion 413 and a second side frame portion 414, the lower cap 42 has a front frame portion 421, a rear frame portion 422, a first side frame portion 423 and a second side frame portion 424, the spacer 43 has a front frame portion 431, a rear frame portion 432, a first side frame portion 433 and a second side frame portion 434. The front frame portion 411 and the rear frame portion 412 of the upper cap 41 respectively cooperate with the front frame portion 431 and the rear frame portion 432 of the spacer 43 so as to define the upper cable passages 44; the front frame portion 421 and the rear frame portion 422 of the lower cap 42 respectively cooperate with the front frame portion 431 and the rear frame portion 432 of the spacer 43 so as to define the lower cable passages 45; and the frame-shaped structure of the upper cap 41, the frame-shaped structure of the lower cap 42 and the frame-shaped structure of the spacer 43 cooperatively define a filling space 46, and all the cables 3 (see FIG. 8) pass through the filling space 46.

Figure 11:
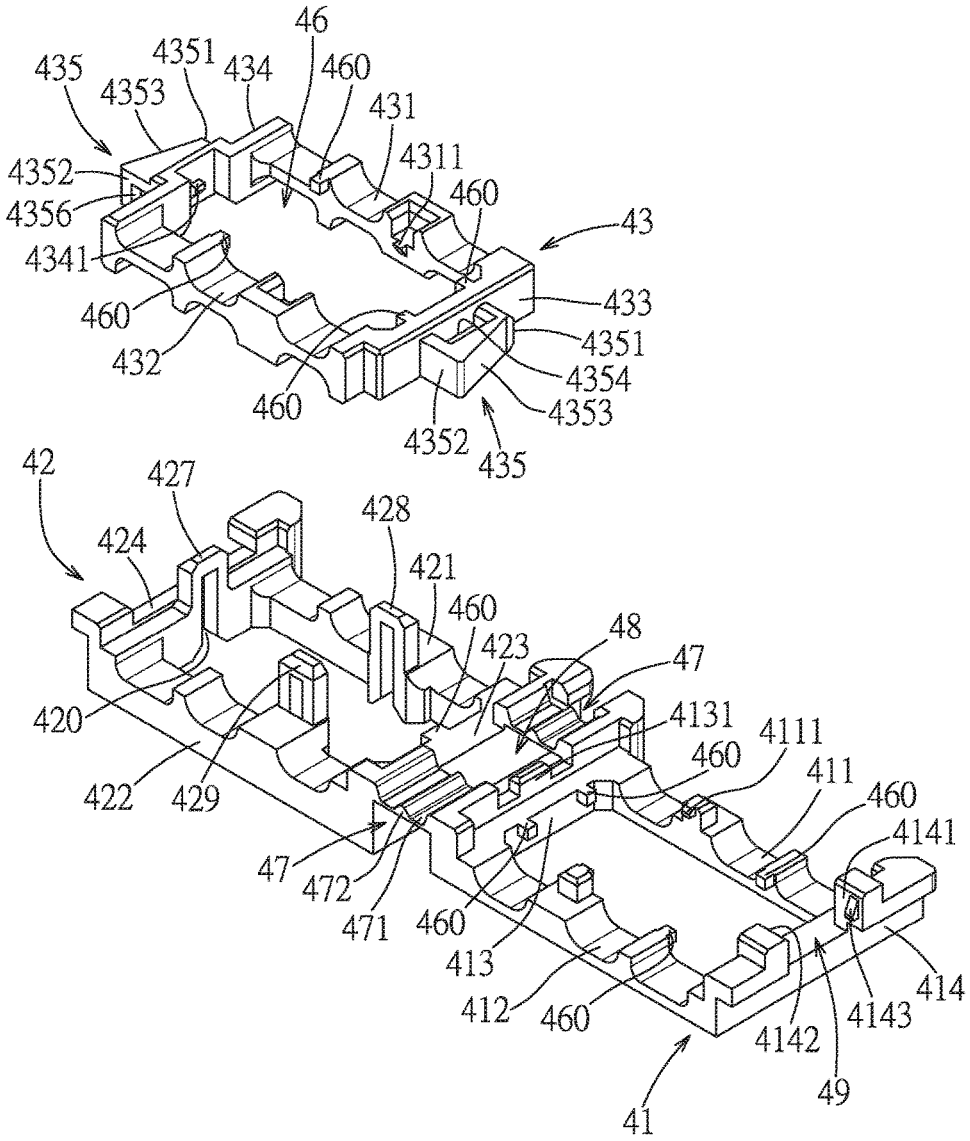
FIG. 11 is an exploded perspective view illustrating a detailed structure of the organizer of the first embodiment.
Figure 12:
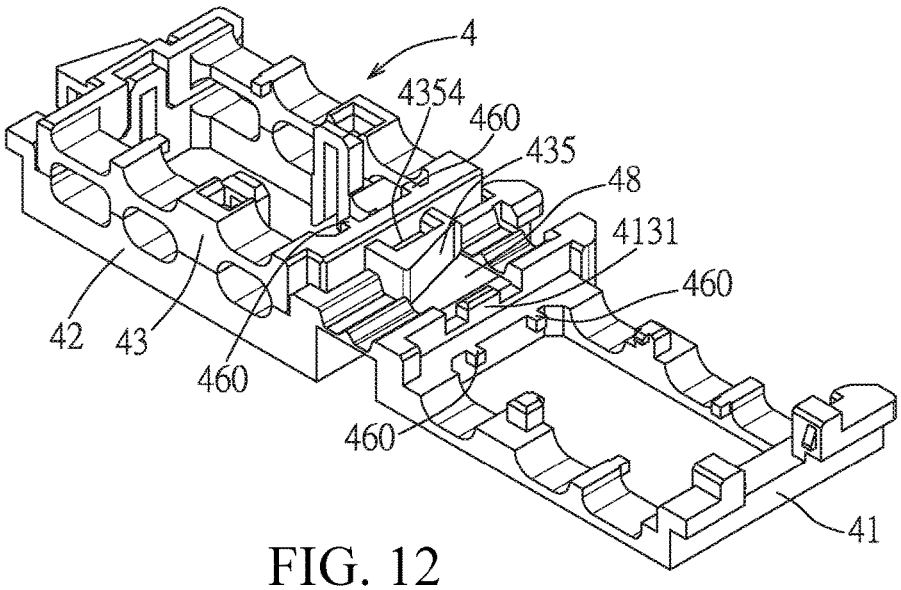
FIG. 12 is a perspective view illustrating that spacer of the organizer of the first embodiment is placed onto the lower cap.

Referring to FIG. 9 and FIG. 11, the organizer 4 further comprises two connecting portions 47 which are flexible, the two connecting portions 47 are spaced apart from each other and each connect the first side frame portion 413 of the upper cap 41 and the first side frame portion 423 of the lower cap 42. In the first embodiment, the two connecting portions 47, the upper cap 41 and the lower cap 42 are integrally formed, and a first latching portion 435 positioned on the first side frame portion 433 of the spacer 43 is positioned between the two connecting portions 47. Furthermore, each connecting portion 47 has a strip body 471 and a protruding rib 472. Two long side edges of the strip body 471 are respectively connected with the first side frame portion 413 of the upper cap 41 and the first side frame portion 423 of the lower cap 42, and the protruding rib 472 protrudes from a surface of the strip body 471 toward the inside of the organizer 4, specifically, the protruding rib 472 extends parallel to the two long side edges of the strip body 471 and is positioned in the middle of the strip body 471, and the protruding rib 472 bulges from two sides respectively close to the two long side edges of the strip body 471 toward the middle of the strip body 471 so as to have a general triangle in cross section, as such, when the upper cap 41 and the lower cap 42 cover each other and cooperatively interpose the spacer 43, the strip body 471 of each of the two connecting portions 47 is supported by the protruding rib 472 so that a middle part of each of the two connecting portions 47 does not protrude outwardly, therefore an outer side surface of each of the two connecting portions 47 is an upright flat surface.

Referring to FIG. 9 to FIG. 12, the first side frame portion 413 of the upper cap 41 and the first side frame portion 423 of the lower cap 42 cooperatively define a first entrance opening 48, and the second side frame portion 414 of the upper cap 41 and the second side frame portion 424 of the lower cap 42 cooperatively define a second entrance opening 49. The first entrance opening 48 and the second entrance opening 49 respectively allow the two first latching portions 435 respectively positioned on the left and the right of the spacer 43 to extend therethrough. And the two first latching portions 435 of the spacer 43 each have a front side surface 4351, a rear side surface 4352 and an outer side surface 4353 connecting the front side surface 4351 and the rear side surface 4352, the rear side surface 4352 further protrudes outwardly relative to the front side surface 4351 so as to allow the outer side surface 4353 to be oblique inwardly from the rear to the front. Here, a top surface of the first latching portion 435 positioned at the first side frame portion 433 of the spacer 43 is formed with a recessed groove 4354, and the first side frame portion 413 of the upper cap 41 is formed with a protrusion 4131 latched into the recessed groove 4354.

Figure 13:
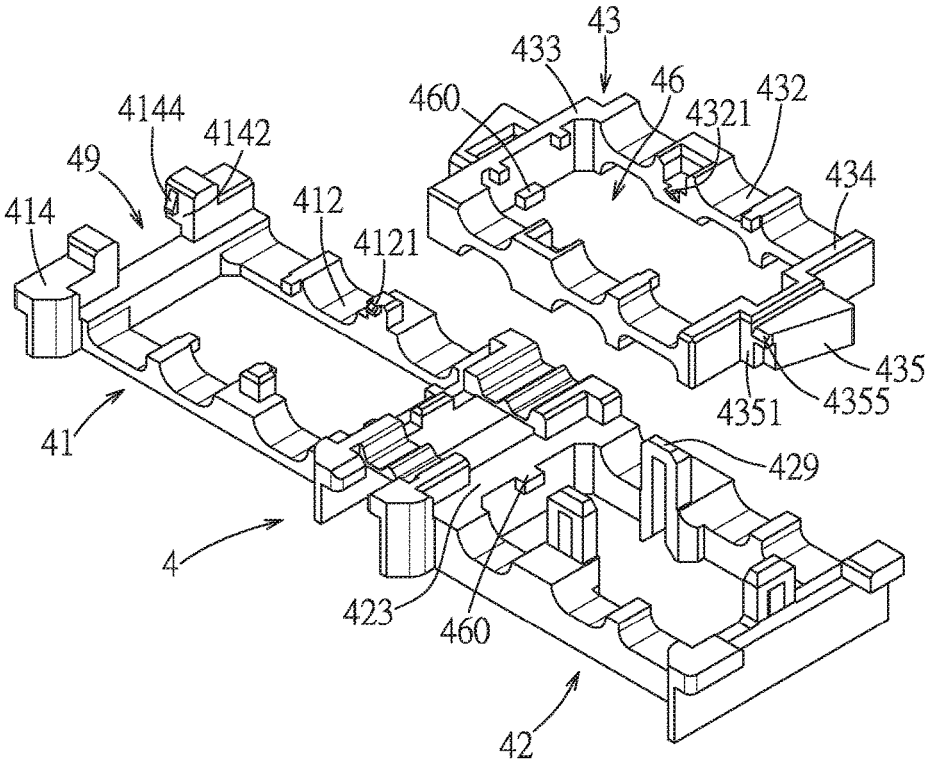
FIG. 13 is an exploded perspective view illustrating the detailed structure of the organizer of the first embodiment viewed from another angle.
Figure 14:
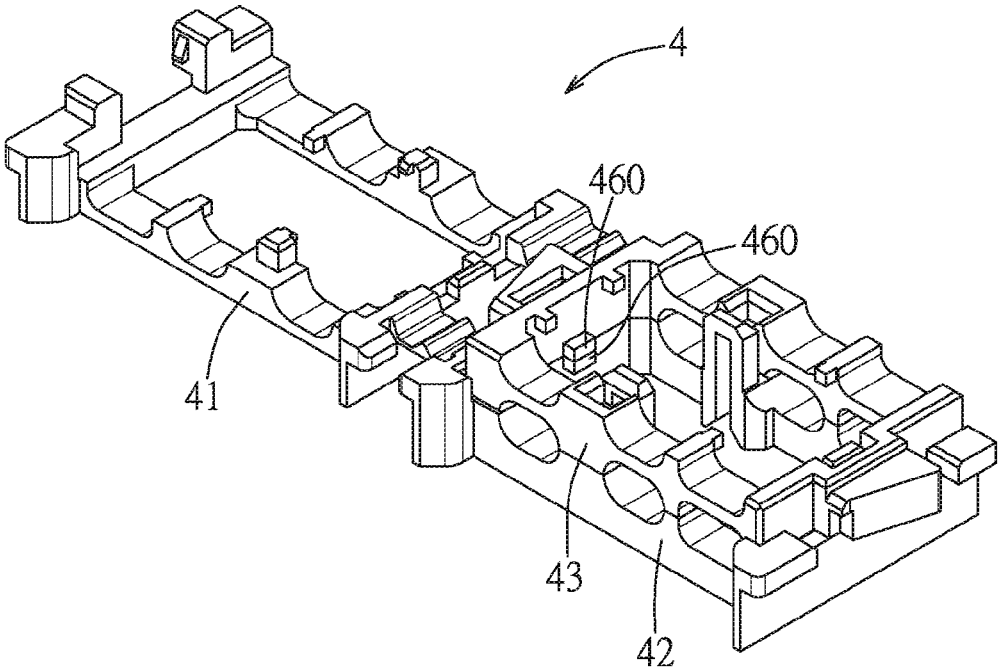
FIG. 14 is a perspective view illustrating that the spacer of the organizer of the first embodiment is placed onto lower cap and viewed from another angle.
Figure 15:
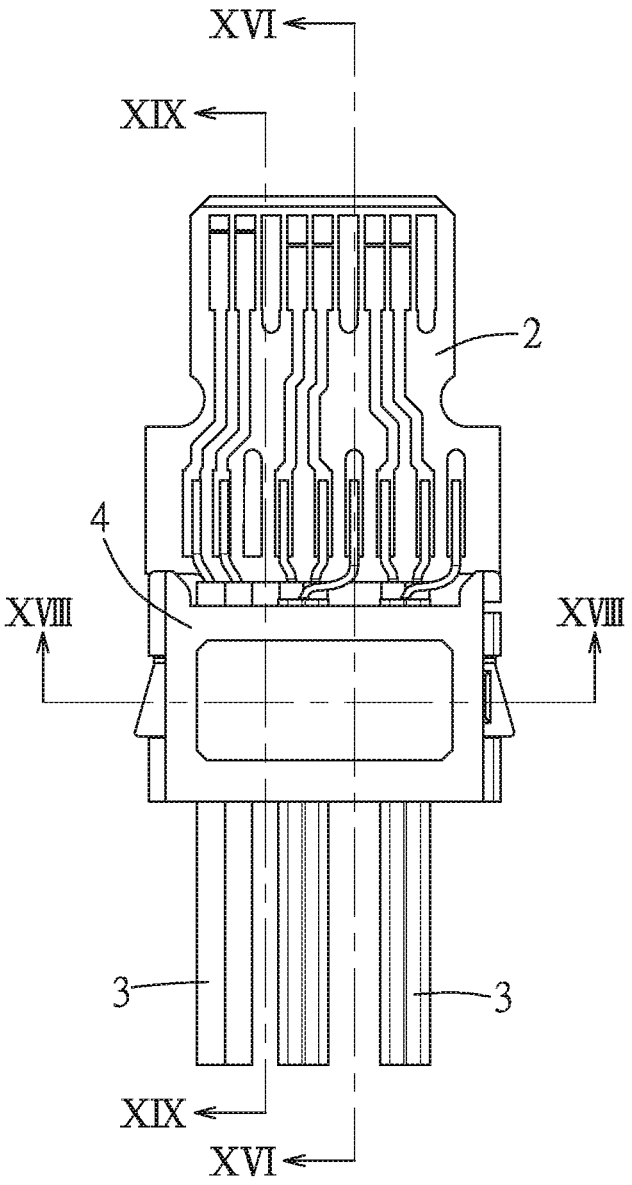
FIG. 15 is a top view of the first embodiment with a housing not shown.
Figure 16:
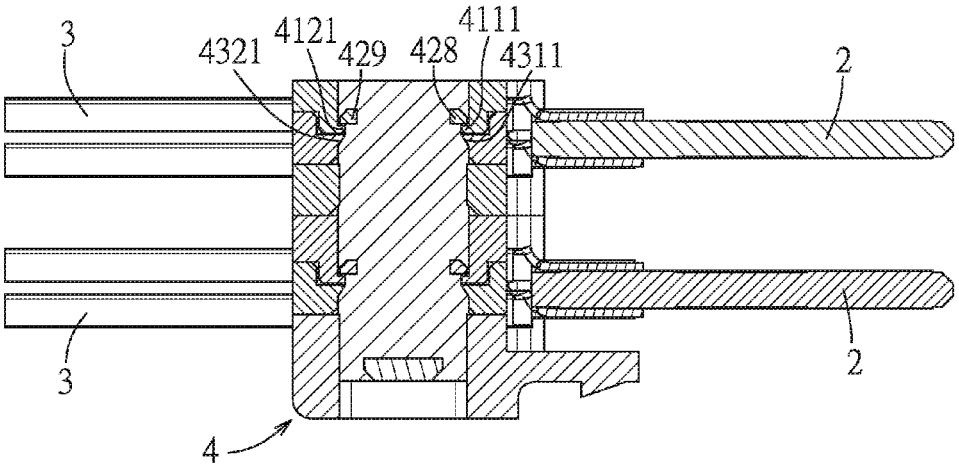
FIG. 16 is a cross sectional view taken along a line XVI-XVI of FIG. 15 and illustrating a snapping structure of the organizer of the first embodiment.
Figure 17:
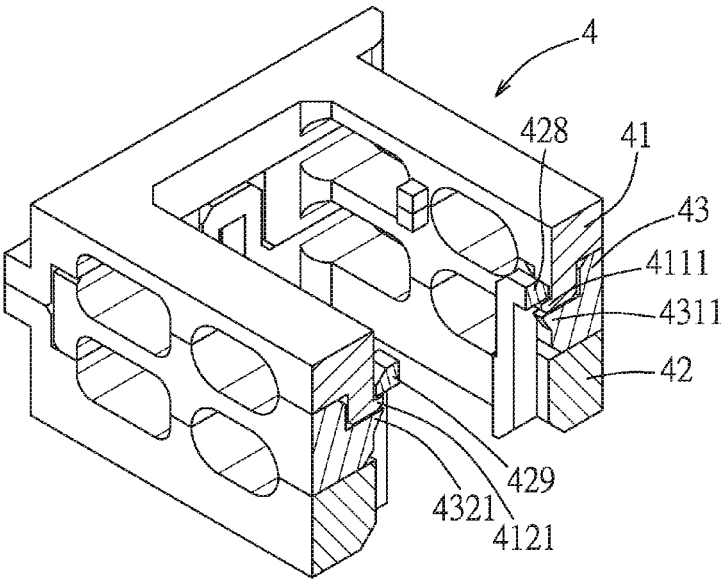
FIG. 17 is a perspective cross sectional view illustrating the snapping structure of the organizer of the first embodiment.

In combination with referring to FIG. 11 and FIG. 13, the front side surface 4351 and the rear side surface 4352 of the first latching portion 435 positioned at the second side frame portion 434 of the spacer 43 are respectively formed with a stopping block 4355 and a stopping block 4356, and the second side frame portion 414 of the upper cap 41 is formed with an inner side surface 4141 and an inner side surface 4142 which face each other and face the second entrance opening 49, a protruding block 4143 protrudes from the inner side surface 4141 and a protruding block 4144 protrudes from the inner side surface 4142, when the upper cap 41 covers the spacer 43 from up to down, the protruding blocks 4143, 4144 are respectively latched with the two stopping blocks 4355, 4356, so as to allow the upper cap 41 and the spacer 43 to be latched with each other. Therefore, by that the protrusion 4131 of the upper cap 41 is latched into the recessed groove 4354 of the spacer 43 and the two protruding blocks 4143, 4144 of the upper cap 41 are respectively latched with the two stopping blocks 4355, 4356 of the spacer 43, the upper cap 41 and the spacer 43 are engaged with each other.

Again referring to FIG. 11, the lower cap 42 further has three latching frames 427, 428, 429. The latching frame 427 is formed at an inner side of the second side frame portion 424, the latching frame 428 is formed at an inner side of the front frame portion 421, and the latching frame 429 is formed at an inner side of the rear frame portion 422. The second side frame portion 434, the front frame portion 431 and the rear frame portion 432 of the spacer 43 are respectively further formed with latching blocks 4341, 4311, 4321 protruding toward the filling space 46, and the front frame portion 411 and the rear frame portion 412 of the upper cap 41 are respectively further formed with latching blocks 4111, 4121 protruding toward the filling space 46.

Referring to FIG. 11, FIG. 13, FIG. 15, FIG. 16 and FIG. 17, the latching block 4341 of the spacer 43 is inserted into the latching frame 427 of the lower cap 42 from outside to inside and is latched with the latching frame 427, so as to position the spacer 43 on the lower cap 42. The latching block 4111 of the upper cap 41 and the latching block 4311 of the spacer 43 are stacked with each other and at the same time are together inserted into the latching frame 428 of the lower cap 42 from outside to inside and are together latched with the latching frame 428; also, the latching block 4121 of the upper cap 41 and the latching block 4321 of the spacer 43 are stacked with each other and at the same time are together inserted into latching frame 429 of the lower cap 42 from outside to inside and are together latched with the latching frame 429. With the above latching relationships, the upper cap 41, the lower cap 42 and the spacer 43 are tightly engaged together.

Referring to FIG. 11 to FIG. 14, FIG. 18 and FIG. 19, the organizer 4 has a plurality of protruding portions 460 protruding into the filling space 46, and the protruding portions 460 respectively positioned at the upper cap 41, the lower cap 42 and the spacer 43. In an embodiment, at least some of protruding portions 460 may be stacked with each other. The function of the protruding portions 460 will be described later.

Again referring to FIG. 6 to FIG. 8, during assembling of the organizer 4 positioned above and the cables 3, first the spacer 43 of the organizer 4 is inserted between the cables 3 which are connected to the mating board 2, and then the spacer 43 together with the cables 3 is placed onto the lower cap 42, next the upper cap 41 covers a top portion of the spacer 43, so as to allow the organizer 4 to interpose and comb the cables 3, and in turn to allow the cables 3 to be separated from each other. And then, the organizer 4 is pushed toward the corresponding mating board 2 to approach and abut against the rear edge 212 of the mating board 2.

Figure 20:
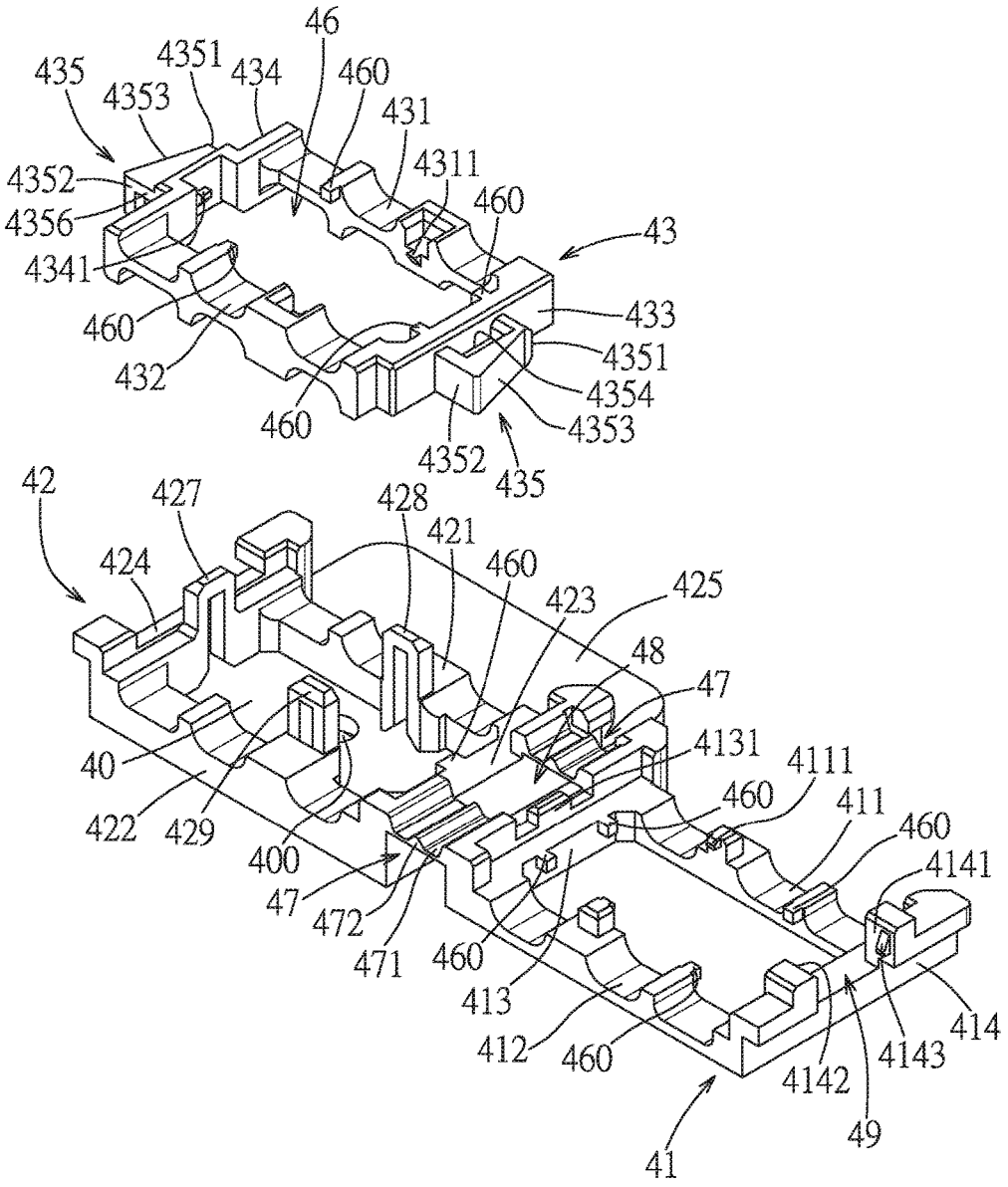
FIG. 20 is an exploded perspective view illustrating a detailed structure of another organizer of the first embodiment.
Figure 21:
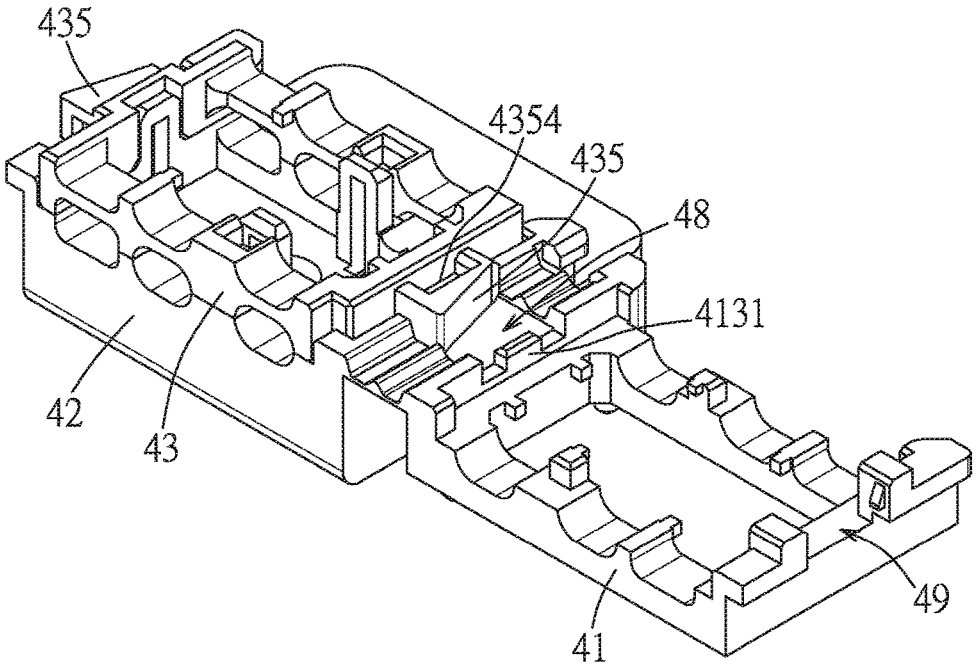
FIG. 21 is a perspective view illustrating that a spacer of the another organizer of the first embodiment is placed onto a lower cap.
Figure 22:
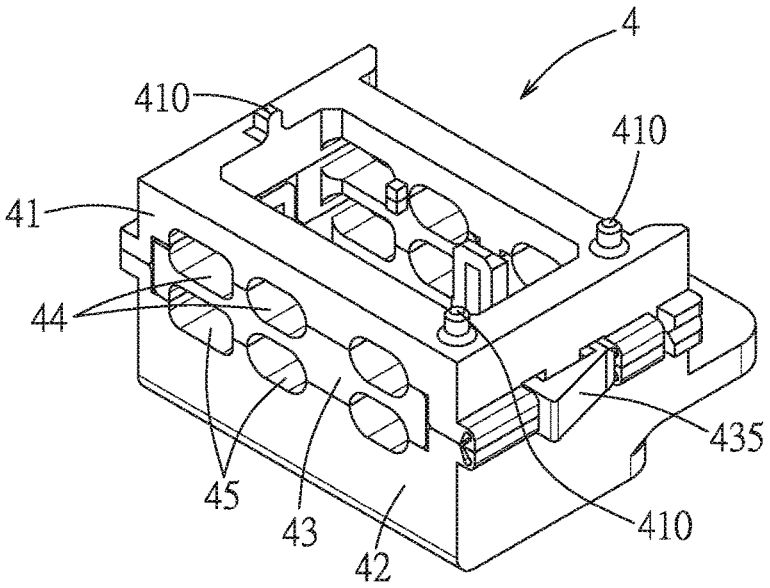
FIG. 22 is a perspective view illustrating an upper cap, the lower cap and a spacer of the another organizer of the first embodiment cooperate with each other to define a plurality of upper cable passages and a plurality of lower cable passages.

Referring to FIG. 20 to FIG. 22, in the first embodiment, the organizer 4 positioned below is substantially the same as the organizer 4 positioned above in structure, however, the organizer 4 positioned below further comprises a bottom plate 40 provided to the lower cap 42 of the organizer 4, the bottom plate 40 is further formed with an injection hole 400.

Figure 23:
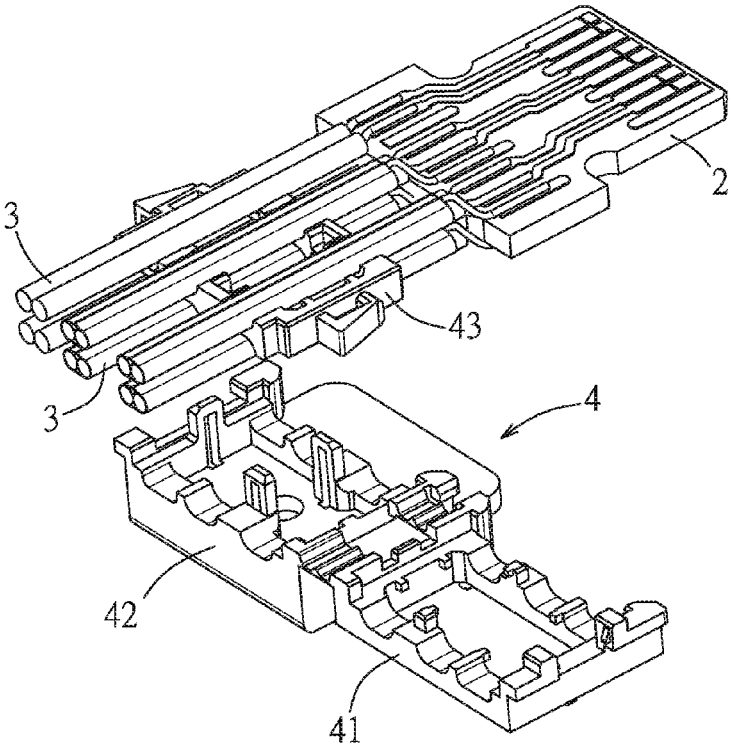
FIG. 23 is a perspective view illustrating that the spacer of the another organizer of the first embodiment is inserted between a plurality of cables.
Figure 24:
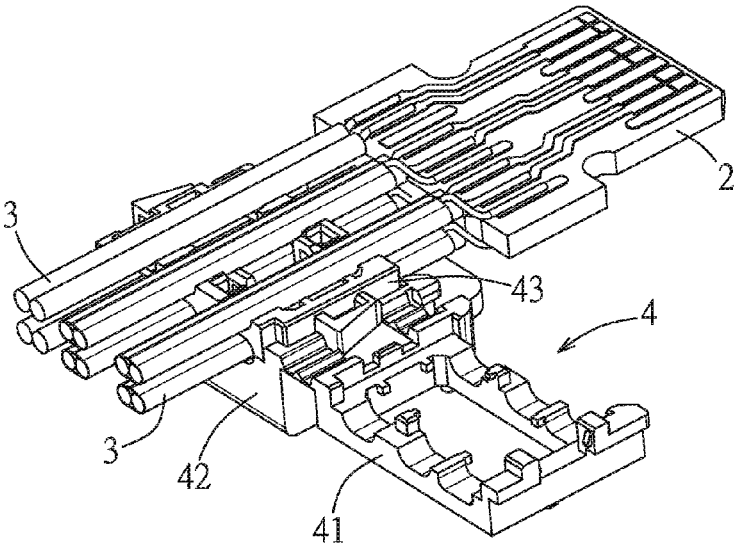
FIG. 24 is a perspective view illustrating an assembling process that the spacer of the another organizer of the first embodiment is placed onto the lower cap.
Figure 25:
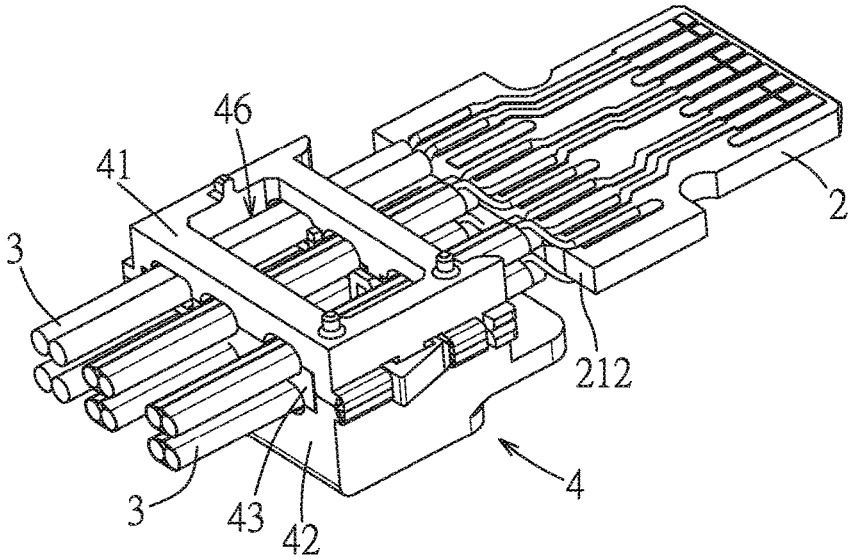
FIG. 25 is a perspective view illustrating that the upper cap of the another organizer of the first embodiment covers the spacer, and the upper cap and the lower cap cooperatively interpose the spacer and the cables.

Referring to FIG. 23 to FIG. 25, similarly, during assembling of the organizer 4 positioned below and the cables 3, first the spacer 43 of the organizer 4 is inserted between the cables 3 which are connected to the corresponding mating board 2, and then the spacer 43 together with the cables 3 is placed on the lower cap 42, next the upper cap 41 covers the spacer 43 and the cables 3 on the spacer 43, so as to allow the organizer 4 to interpose and comb the cables 3, and in turn allow the cables 3 to be separated from each other. And then the organizer 4 is pushed toward the corresponding mating board 2 to approach and abut against the rear edge 212 of the mating board 2.

Figure 26:
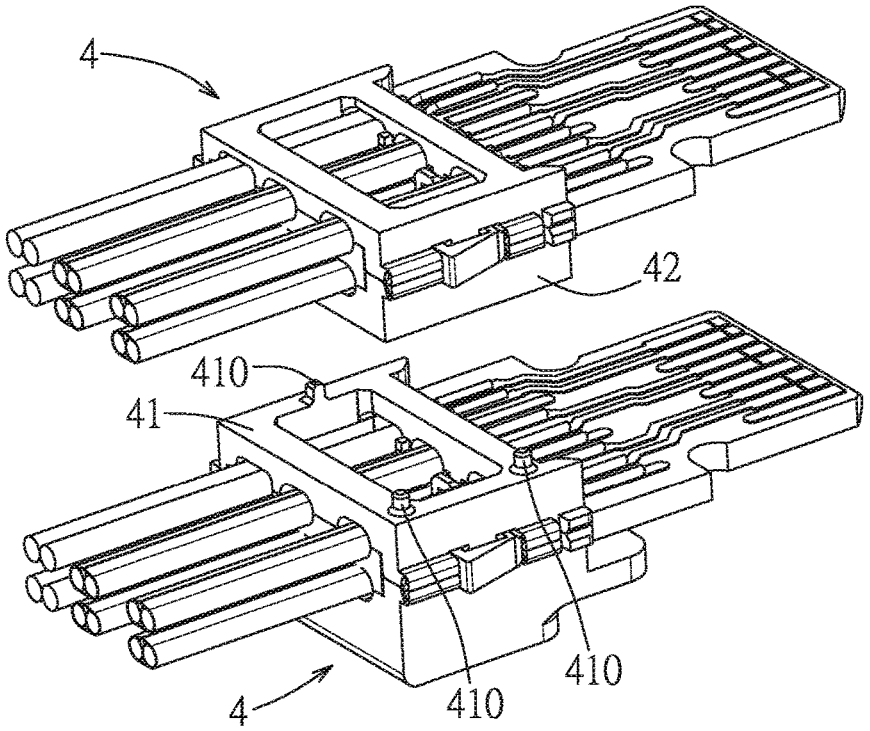
FIG. 26 is a perspective view illustrating that the another organizer of the first embodiment is provided with a plurality of positioning posts.
Figure 27:
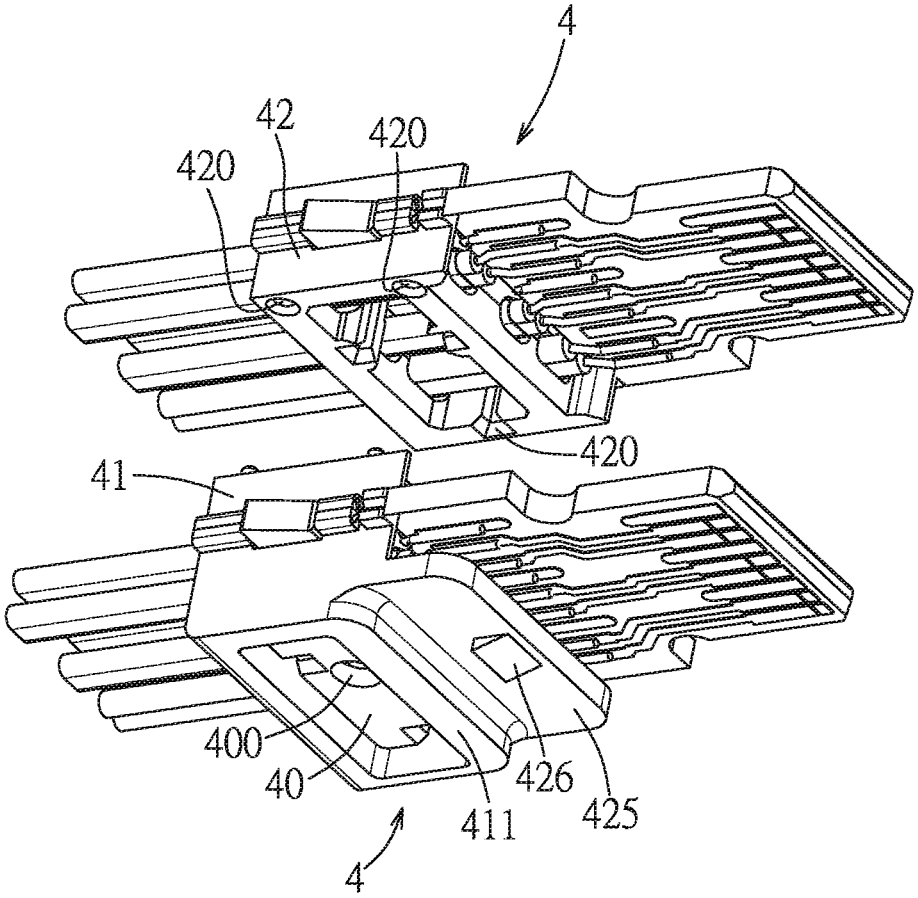
FIG. 27 is a perspective view illustrating that the another organizer of the first embodiment is provided with a plurality of positioning holes.

The following assembling process can be used on a cable connector as disclosed herein. Referring to FIG. 26 and FIG. 27, the two organizers 4 are stacked along the vertical direction, and the upper cap 41 of the organizer 4 positioned below is provided with three positioning posts 410, and the lower cap 42 of the organizer 4 positioned above is provided with three positioning holes 420 which respectively cooperate with the three positioning posts 410, by that the three positioning posts 410 are respectively latched into the three positioning holes 420, the two organizers 4 are positioned relative to each other. It should be especially noted that, one of the three positioning holes 420 provided to the lower cap 42 of the organizer 4 positioned above is communicated with the latching frame 427 (see FIG. 11).

Figure 18:
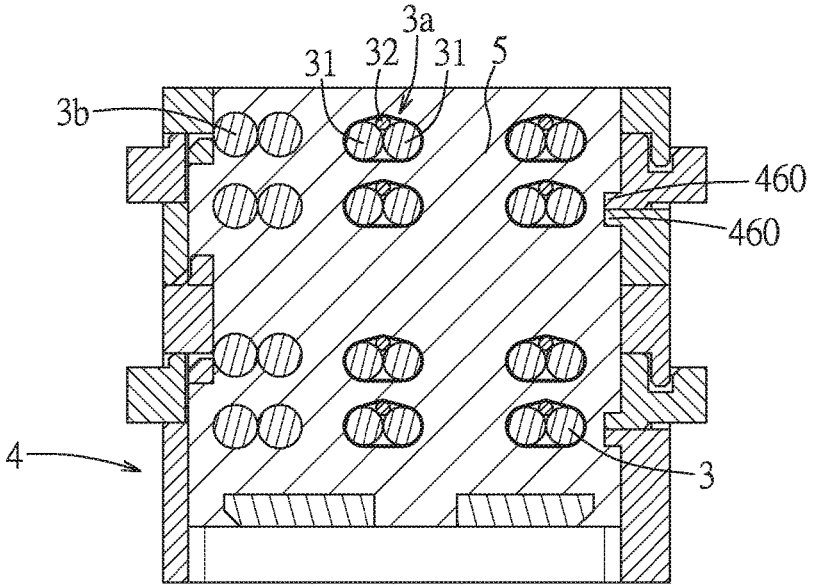
FIG. 18 is a cross sectional view taken along a line XVIII-XVIII of FIG. 15 and illustrating that a plurality of protruding portions of the organizer of the first embodiment are stacked with each other.
Figure 19:
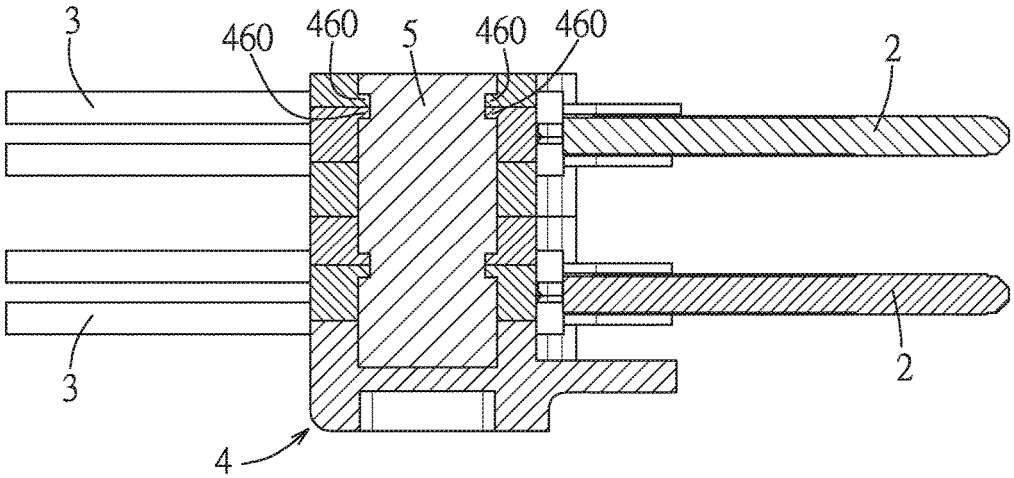
FIG. 19 is a cross sectional view taken along a line XIX-XIX of FIG. 15 and illustrating that the plurality of protruding portions of the organizer of the first embodiment are stacked with each other.

In combination with referring to FIG. 1 and FIG. 2, next the binding material 5 is injected into the two filling spaces 46 via the injection hole 400 of the bottom plate 40, so as to allow the two organizers 4 and the cables 3 to be tightly engaged with each other via the binding material 5, because the two filling spaces 46 of the two organizers 4 are communicated with each other along the vertical direction, only the binding material 5 is filled one time, the cables 3 can be fixed to the two organizers 4, so as to attain a purpose that assembling is simple and time and labor are save. It should be especially noted that, as shown in FIG. 18 and FIG. 19, by that the protruding portions 460 respectively protrude toward the corresponding filling space 46, a contact surface area between the two organizers 4 and the binding material 5 may be increased, so as to improve the engagement strength between the two organizers 4 and the binding material 5; in addition, the binding material 5 can enclose some of the protruding portions 460 stacked with each other, so as to allow the upper cap 41 and the spacer 43 to be tightly engaged together and the lower cap 42 and the spacer 43 to be tightly engaged together.

Again referring to FIG. 3, FIG. 4 and FIG. 5, finally the two mating boards 2 and the two organizers 4 are inserted into the housing 1, so as to allow the cables 3 to extend outwardly from the rear side 12, as such, assembling of the cable connector is completed. Because the spacer 43 of each organizer 4 further has the two first latching portions 435 respectively provided to the first side frame portion 433 and the second side frame portion 434 of the spacer 43, and the housing 1 further has four second latching portions 17 correspondingly formed to the two side walls 13, the second latching portions 17 respectively cooperate with the first latching portions 435. In the first embodiment, each first latching portion 435 is a latching block, each second latching portion 17 is a latching hole, by that the first latching portions 435 are respectively latched with the second latching portions 17, each organizer 4 is positioned in the housing 1. Of course, each first latching portion 435 may also be a latching hole, each second latching portion 17 is a latching block, which may also attain a purpose that each organizer 4 is positioned in the housing 1.

In addition, in combination with referring to FIG. 27, the lower cap 42 of the organizer 4 positioned below further has an extension plate 425 extending forwardly from the front frame portion 411 of the organizer 4, and a third latching portion 426 formed on a bottom side of the extension plate 425; and the housing 1 further has a fourth latching portion 18 formed on the bottom wall 14, the fourth latching portion 18 cooperates with the third latching portion 426. In the first embodiment, the third latching portion 426 is a protruding block, and the fourth latching portion 18 is a through hole, by that the third latching portion 426 and the fourth latching portion 18 are latched with each other, the organizer 4 can be also positioned in the housing 1. It should be noted that, because the two organizers 4 respectively abut against the two rear edges 212 of the two mating boards 2, the two organizers 4 help eliminate a stress at a distal end of each of the cables 3 during operation.

Figure 28:
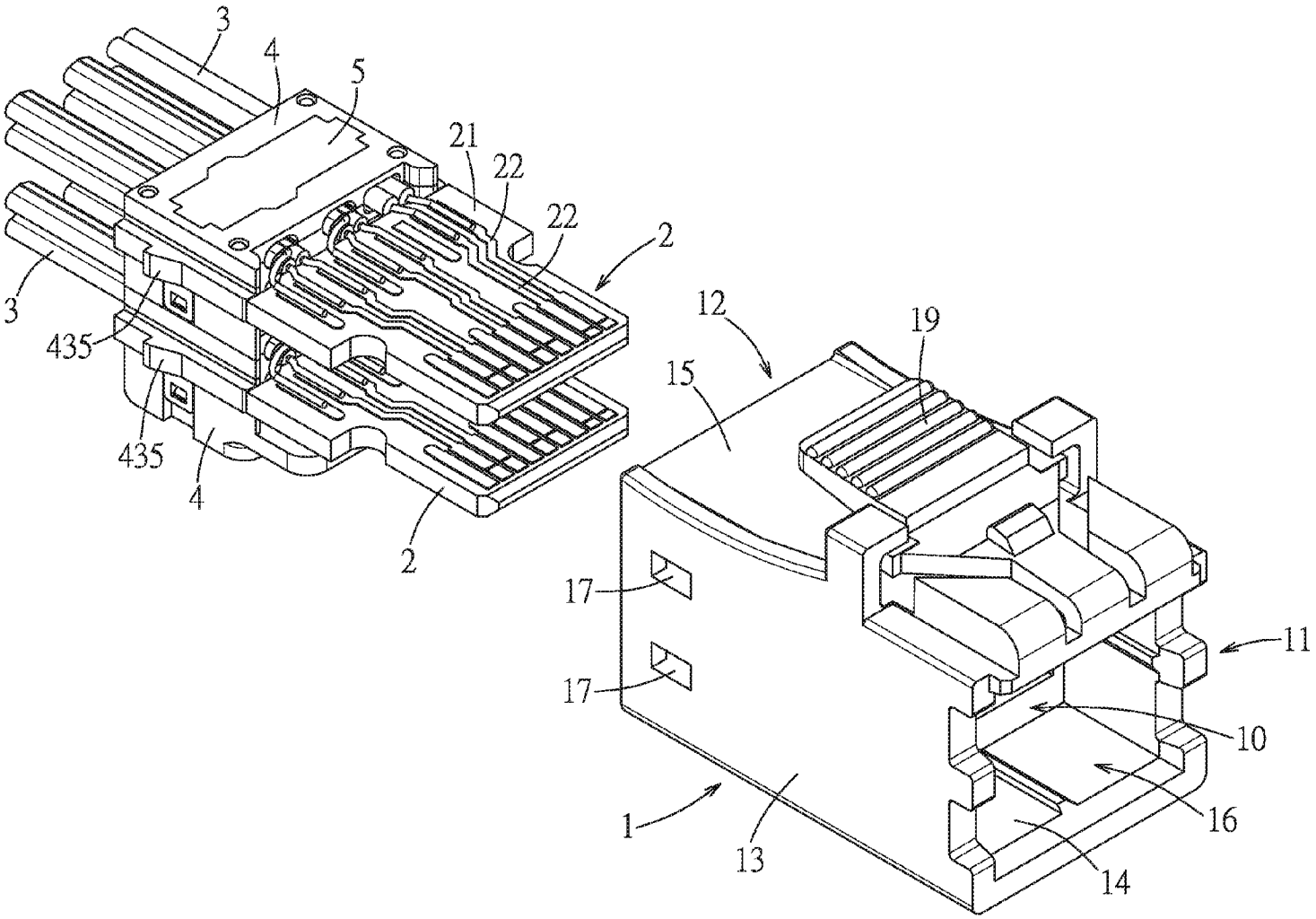
FIG. 28 is an exploded perspective view illustrating a second embodiment of the cable connector.
Figure 29:
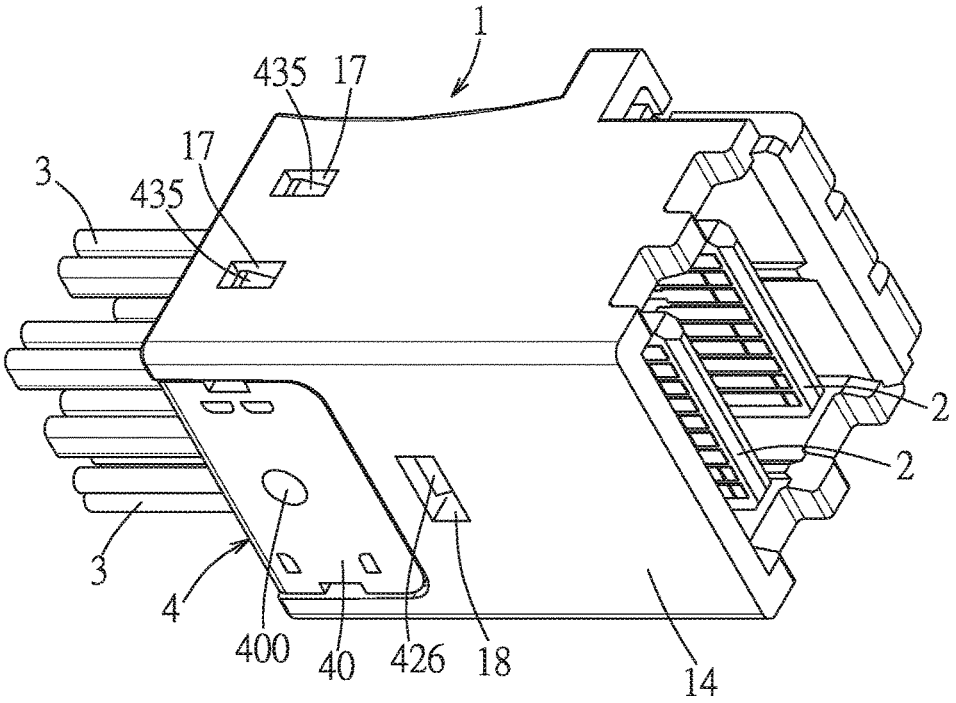
FIG. 29 is a perspective view illustrating an assembled state of the second embodiment.
Figure 30:
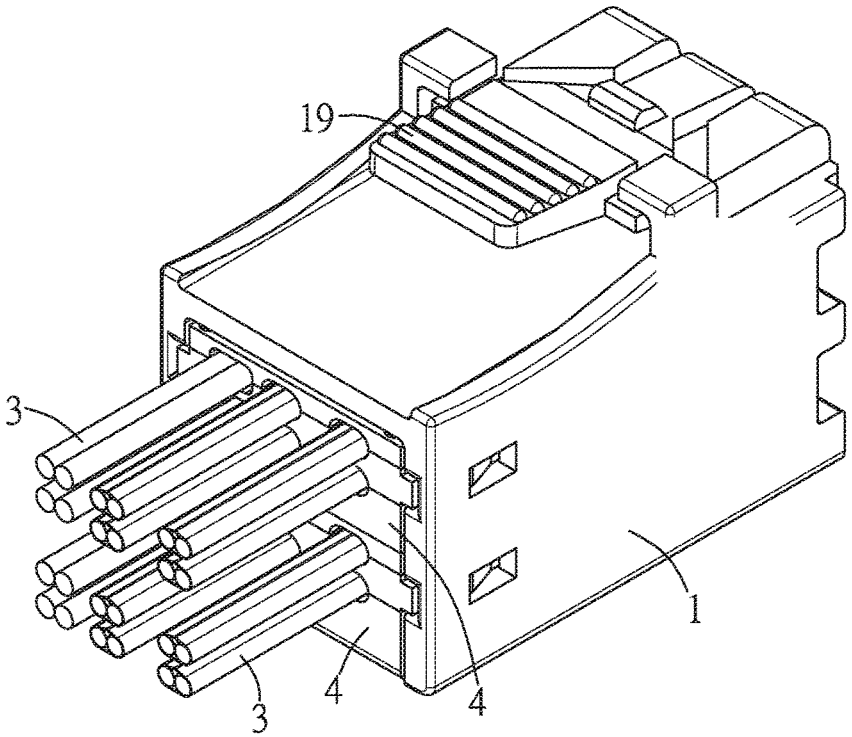
FIG. 30 is a perspective view illustrating the assembled state of the second embodiment viewed from another angle.
Figure 31:
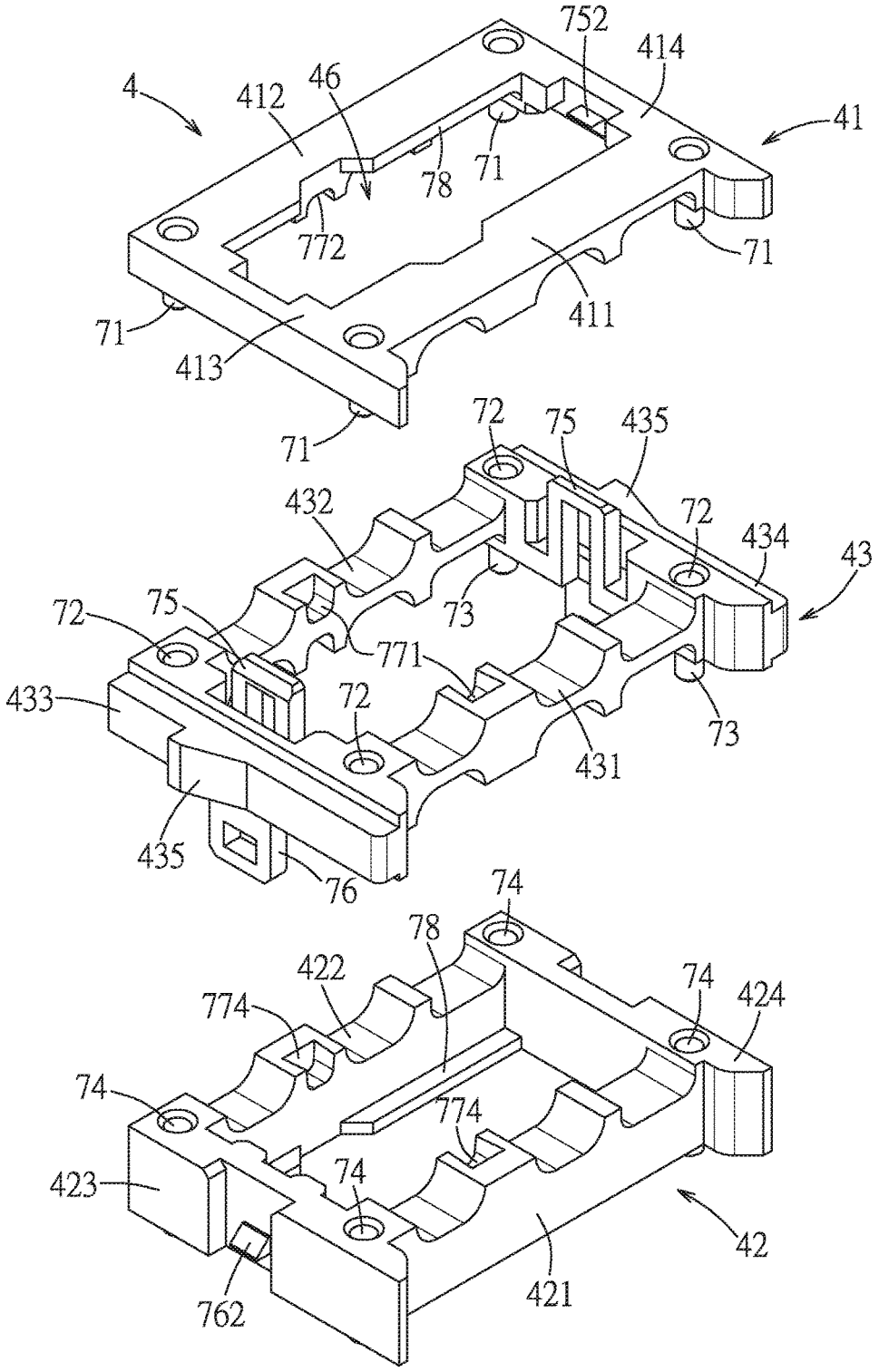
FIG. 31 is an exploded perspective view illustrating a detailed structure of an organizer of the second embodiment.
Figure 32:
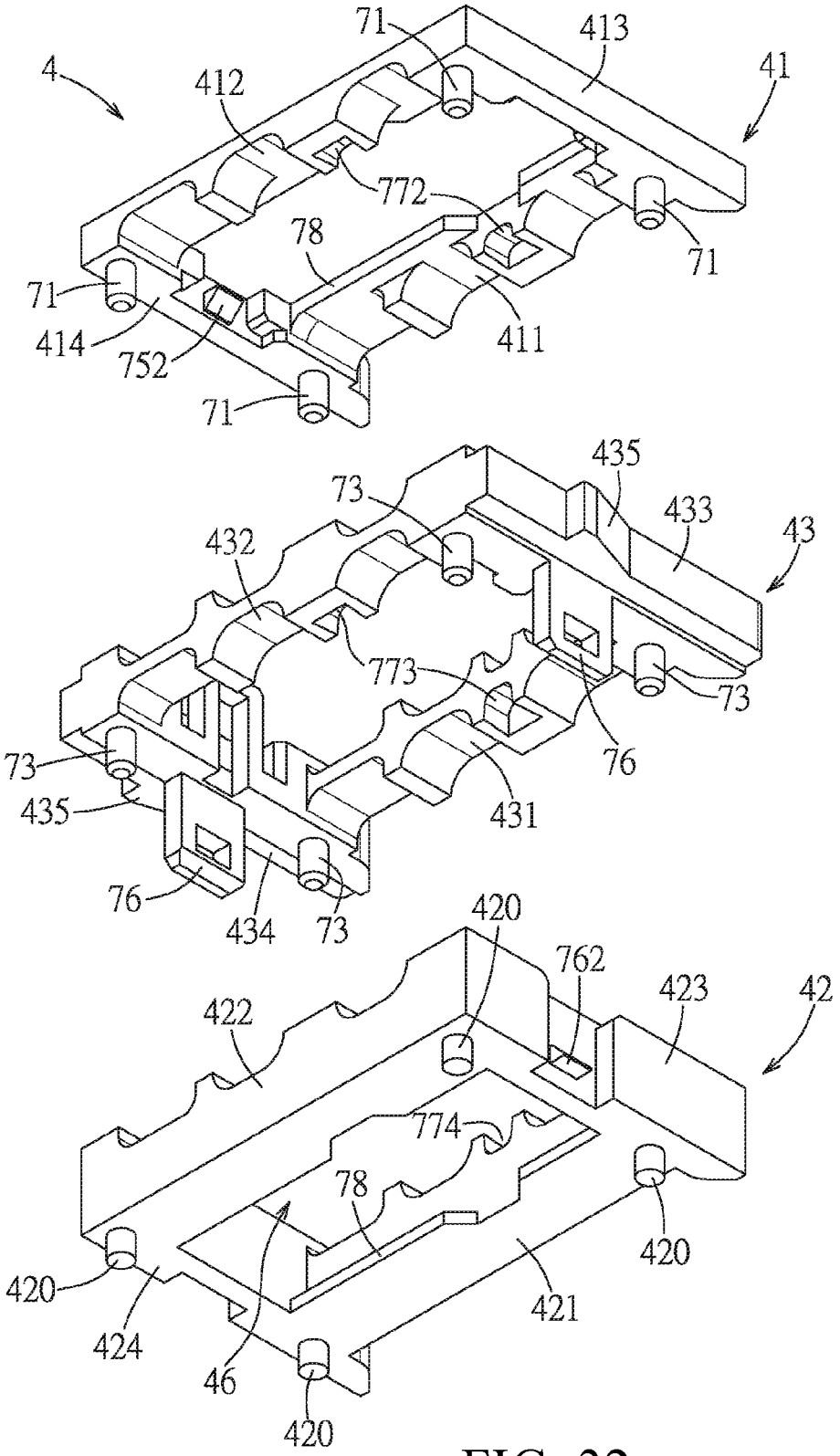
FIG. 32 is an exploded perspective view illustrating the detailed structure of the organizer of the second embodiment viewed from another angle.
Figure 33:
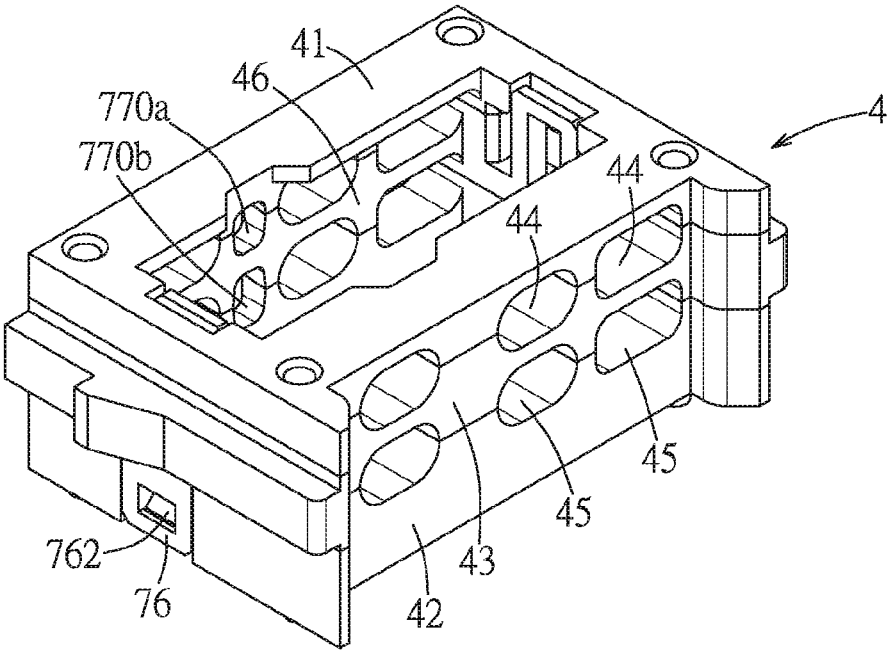
FIG. 33 is a perspective view illustrating an upper cap, a lower cap and a spacer of the organizer of the second embodiment cooperate with each other to define a plurality of upper cable passages and a plurality of lower cable passages.
Figure 34:
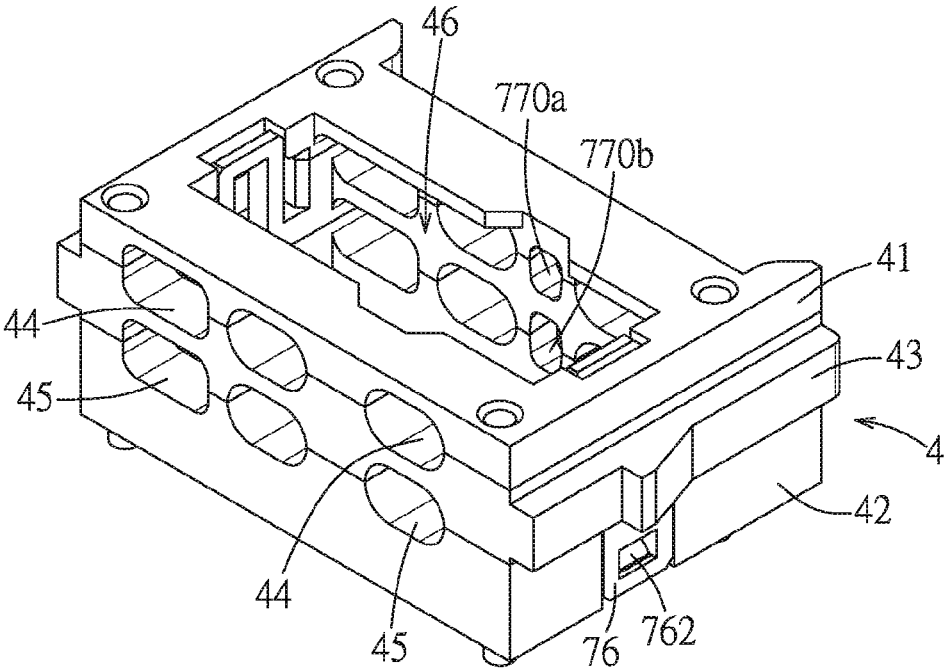
FIG. 34 is a perspective view illustrating the organizer of the second embodiment viewed from another angle.
Figure 35:
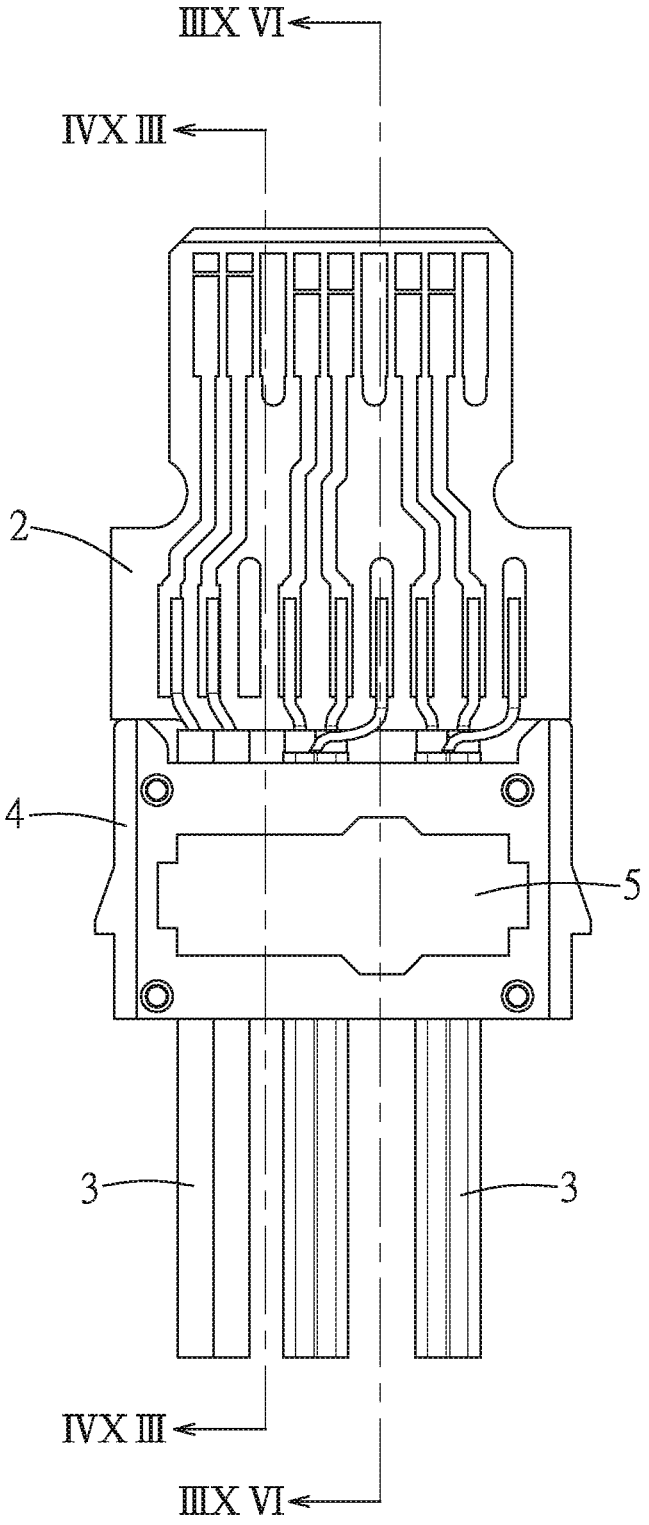
FIG. 35 is a top view of the second embodiment with a housing not shown.

Referring to FIG. 28, FIG. 29 and FIG. 30, a second embodiment of a cable connector is substantially the same as the first embodiment in main structure, however, as shown in FIG. 31 to FIG. 34, an upper cap 41, a lower cap 42 and a spacer 43 of each organizer 4 of the second embodiment each are respectively a separate element, and a connecting relationship among the three elements is as follows. With respect to the organizer 4 positioned above, the upper cap 41 and the spacer 43 are stacked along the vertical direction, and a bottom portion of the upper cap 41 is provided with four first snapping portions 71, a top portion of the spacer 43 is provided with four second snapping portions 72 which respectively cooperate with the four first snapping portions 71. In the second embodiment, each first snapping portion 71 is a protruding post, each second snapping portion 72 is a recessed hole, by that the first snapping portions 71 are respectively snapped with the second snapping portion 72, so as to position the upper cap 41 and the spacer 43 relative to each other; also, the spacer 43 and the lower cap 42 are stacked along the vertical direction, and a bottom portion of the spacer 43 is provided with four third snapping portions 73, a top portion of the lower cap 42 is provided with four fourth snapping portions 74 which respectively cooperate with and the four third snapping portions 73, similarly, each third snapping portion 73 is a protruding post, each fourth snapping portion 74 is a recessed hole, by that the third snapping portions 73 are respectively snapped with the fourth snapping portions 74, so as to position the spacer 43 and the lower cap 42 relative to each other. Of course, each first snapping portion 71 may be a recessed hole and each second snapping portion 72 may be a protruding post, the upper cap 41 and the spacer 43 can be also connected together by respectively engaging the recessed holes with the protruding posts; similarly, each third snapping portion 73 may be also a recessed hole and each fourth snapping portion 74 may also be a protruding post, so that the spacer 43 and the lower cap 42 can be also connected together by respectively engaging the recessed holes with the protruding posts, and so the snapping structure disclosed in the second embodiment is not used as limitation.

In addition, the spacer 43 further has two latching frames 75 extending upwardly respectively from a first side frame portion 433 and a second side frame portion 434 of the spacer 43, and an inner side of a first side frame portion 413 of the upper cap 41 and an inner side of a second side frame portion 414 of the upper cap 41 are respectively formed with two latching blocks 752 protruding toward a filling space 46, by that the latching blocks 752 respectively are inserted into the latching frames 75 from outside to inside and are respectively latched with the latching frames 75, the upper cap 41 and the spacer 43 are engaged with each other. Moreover, the spacer 43 further has two latching frames 76 extending downwardly respectively from the first side frame portion 433 and the second side frame portion 434 of the spacer 43, and an outer side of a first side frame portion 423 of the lower cap 42 and an outer side of a second side frame portion 424 of the lower cap 42 are respectively formed with two latching blocks 762 protruding a direction away from the filling space 46, by that the latching blocks 762 are respectively inserted into the latching frames 76 from inside to outside and are respectively latched with the latching frames 76, the lower cap 42 and the spacer 43 are engaged with each other.

Figure 36:
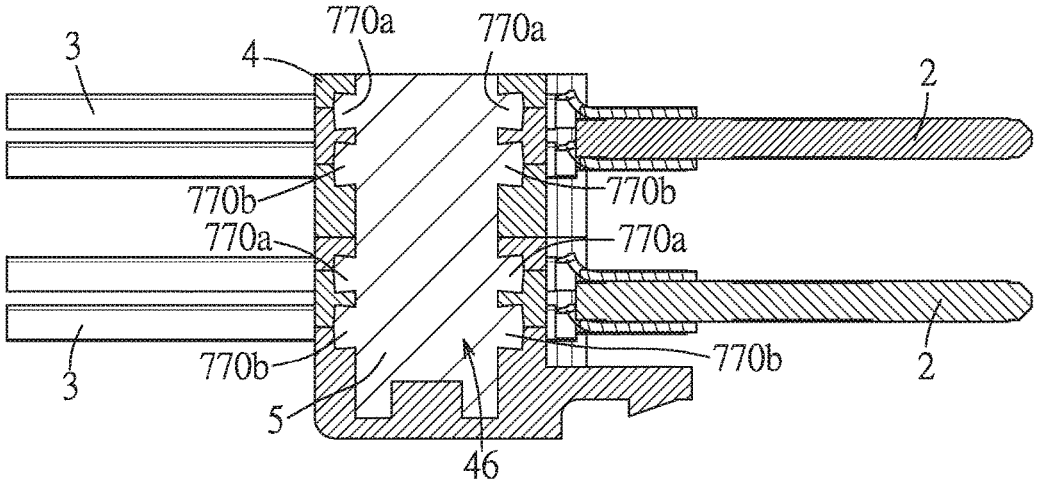
FIG. 36 is a cross sectional view taken along a line IIIXVI-IIIXVI of FIG. 35 and illustrating a plurality of blind holes of the second embodiment.

Referring to FIG. 31 to FIG. 36, a front frame portion 411 and a rear frame portion 412 of the upper cap 41 respectively cooperate with a front frame portion 431 and a rear frame portion 432 of the spacer 43 to define two blind holes **770*a* opened toward the filling space 46, and a front frame portion 421 and a rear frame portion 422 of the lower cap 42 respectively cooperate with a front frame portion 431 and a rear frame portion 432 of the spacer 43 to define two blind holes 770*b* opened toward the filling space 46, the blind holes 770*a*, 770*b* each are a blind hole which is narrow at the opened position and wide at the inside and are communicated with the filling space 46. Each blind hole 770*a* is formed by two blind grooves 771, 772, and each blind hole 770*b* is formed by two blind groove 773, 774. As shown in FIG. 36, because the blind holes 770*a*, 770*b* each are a structure which is narrow at the opened position and wide at the inside, after the binding material 5 is injected into the filling space 46, the tightness between the binding material 5 and the two organizers 4 may be increased, so the binding material 5 is not easily detached from the filling space 46**.

In addition, the organizer 4 further has a plurality of ribs portion 78 protruding toward the filling space 46, and the rib portions 78 are respectively positioned at the upper cap 41, the lower cap 42 and the spacer 43. In combination with referring to FIG. 43, by that the rib portions 78 respectively protruding toward the filling space 46, the contact surface area between the organizer 4 and the binding material 5 may be increased, so as to improve the engagement strength between the organizer 4 and the binding material 5.

Figure 37:
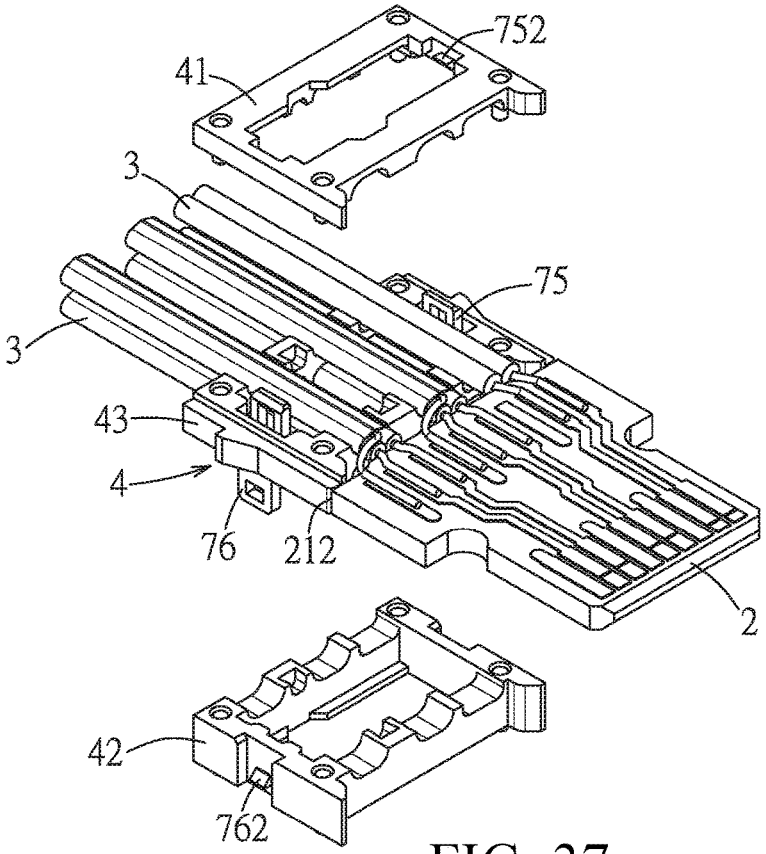
FIG. 37 is a perspective view illustrating an assembling process of the second embodiment.

Referring to FIG. 37, during assembling of the organizer 4 positioned above and the cables 3, first the spacer 43 of the organizer 4 is inserted between the cables 3 which are connected to a mating board 2, and then the spacer 43 is pushed toward the mating board 2 to approach and abut against a rear edge 212 of the mating board 2, next the upper cap 41 and the lower cap 42 respectively cover the top portion and the bottom portion of the spacer 43, so as to allow the organizer 4 to interpose and comb the cables 3, and in turn allow the cables 3 to be separated from each other.

Figure 38:
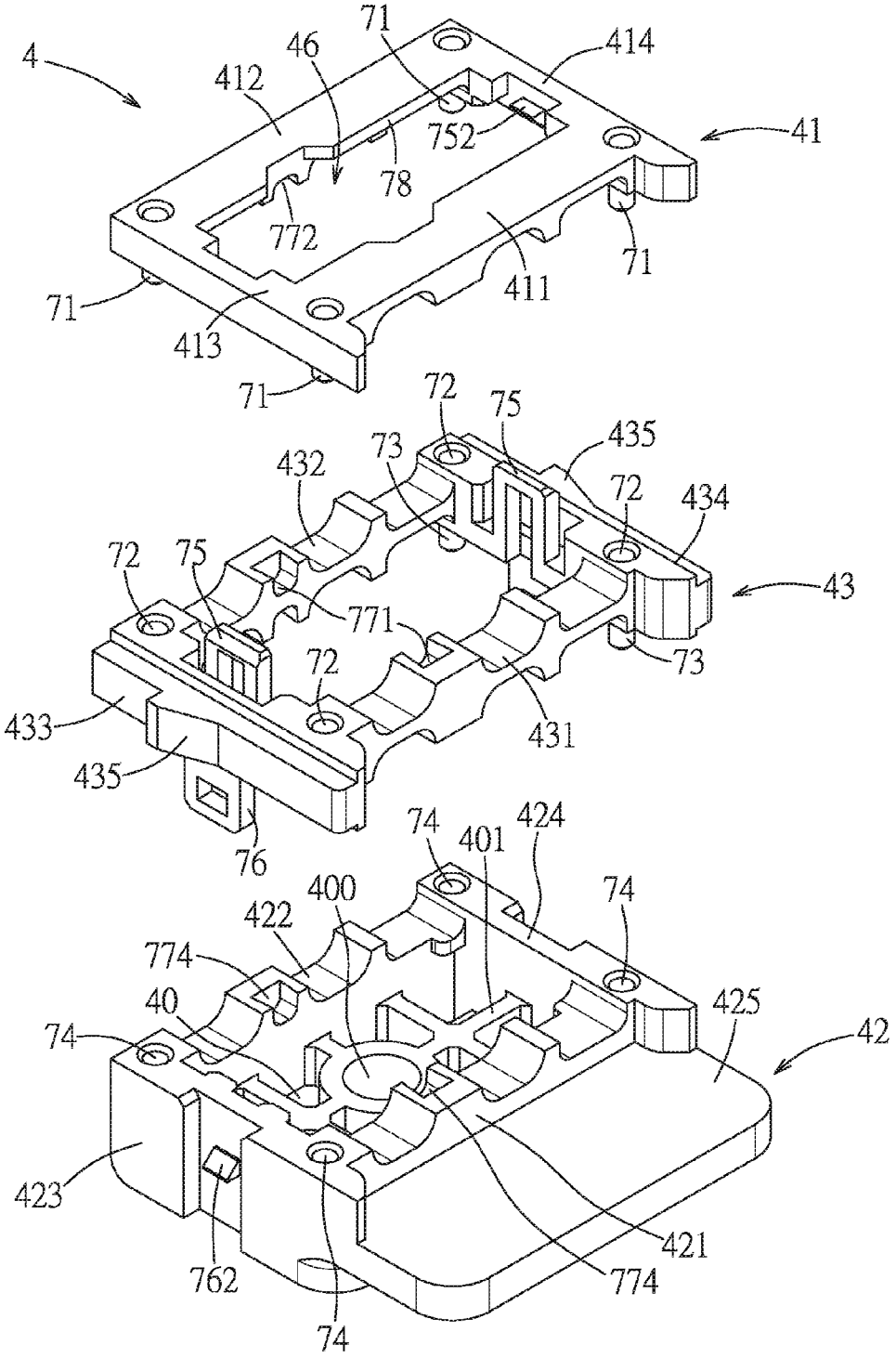
FIG. 38 is a perspective view illustrating a detailed structure of another organizer of the second embodiment.
Figure 39:
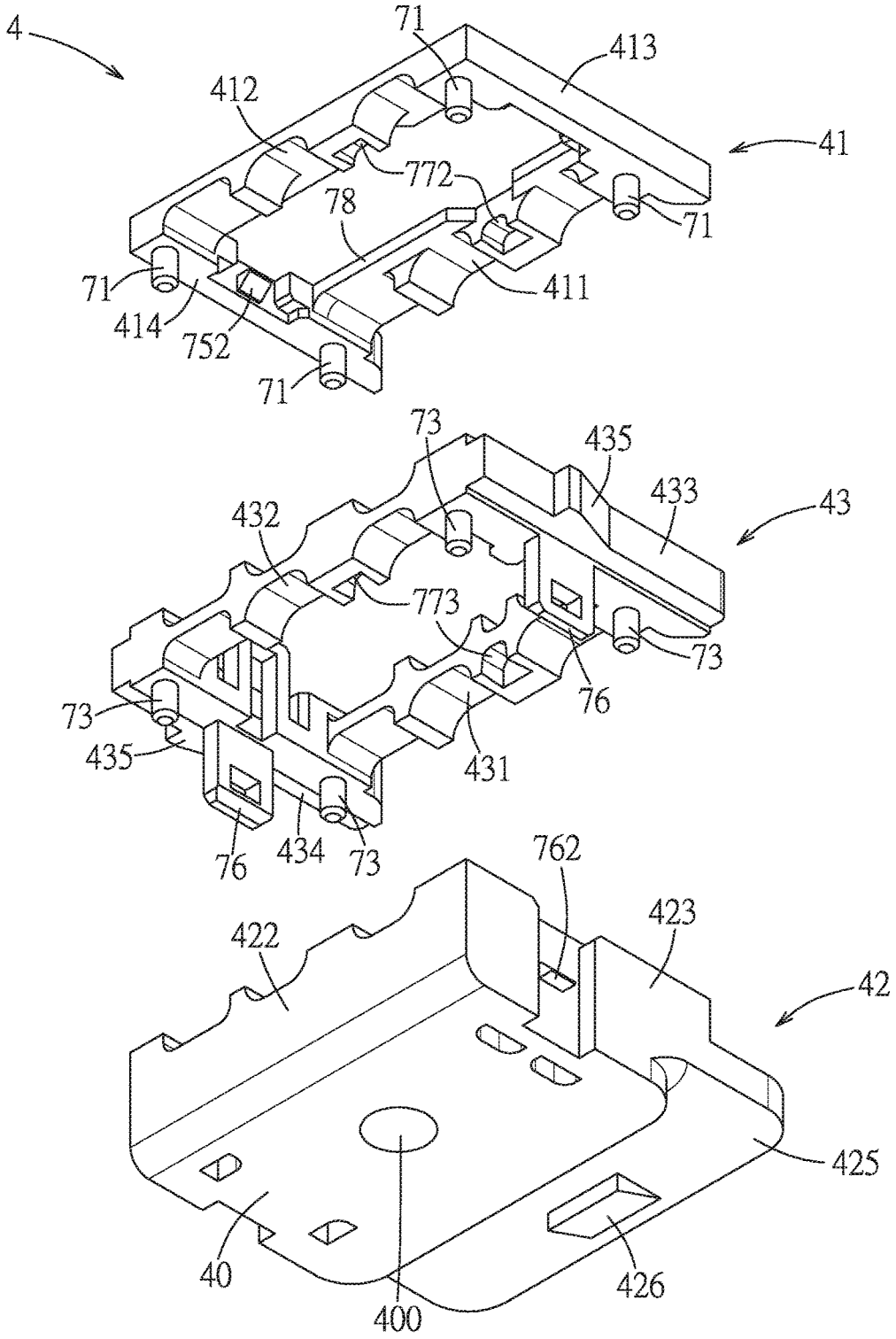
FIG. 39 is a perspective view illustrating the detailed structure of the another organizer of the second embodiment viewed from another angle.
Figure 40:
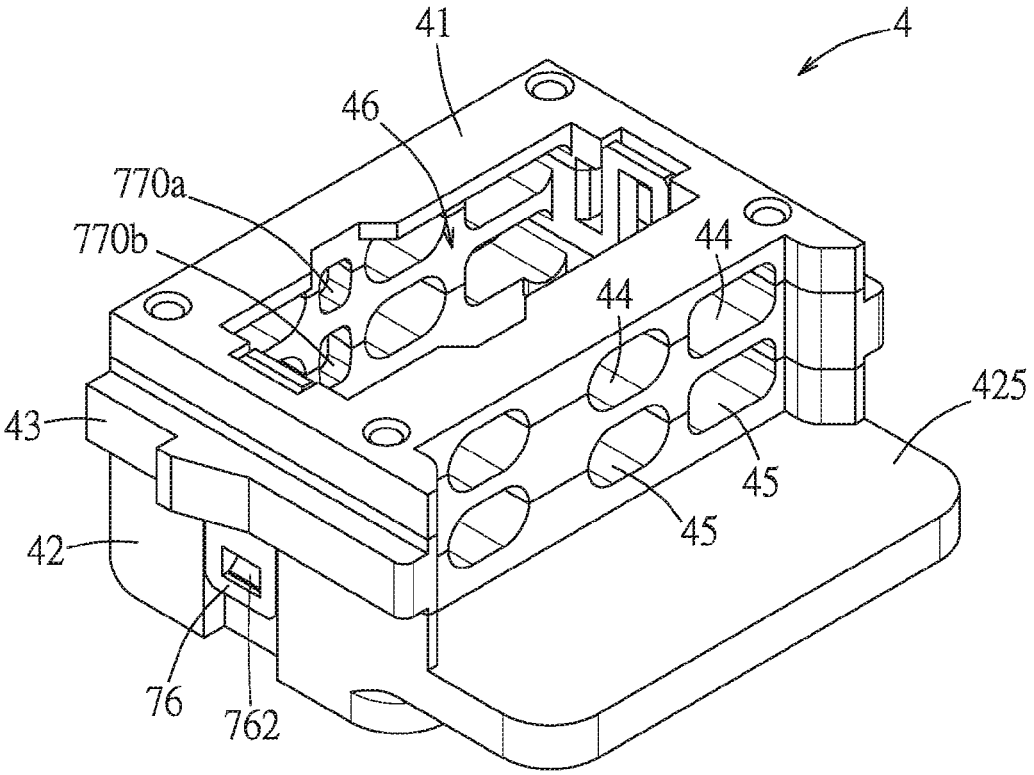
FIG. 40 is a perspective view illustrating that an upper cap, a lower cap and a spacer of the another organizer of the second embodiment cooperate with each other to define a plurality of upper cable passages and a plurality of lower cable passages.

Referring to FIG. 38, FIG. 39 and FIG. 40, in the second embodiment, the organizer 4 positioned below and the organizer 4 positioned above are substantially same in structure, however, the organizer 4 positioned below further comprises a bottom plate 40 provided to the lower cap 42 and a rib 401 formed on the bottom plate 40, and the bottom plate 40 is further formed with an injection hole 400. The protruding structure of the rib 401 may also increase a contact surface area between the organizer 4 and the binding material 5 (see FIG. 36), so as to improve the engagement strength between the organizer 4 and the binding material 5.

Figure 41:
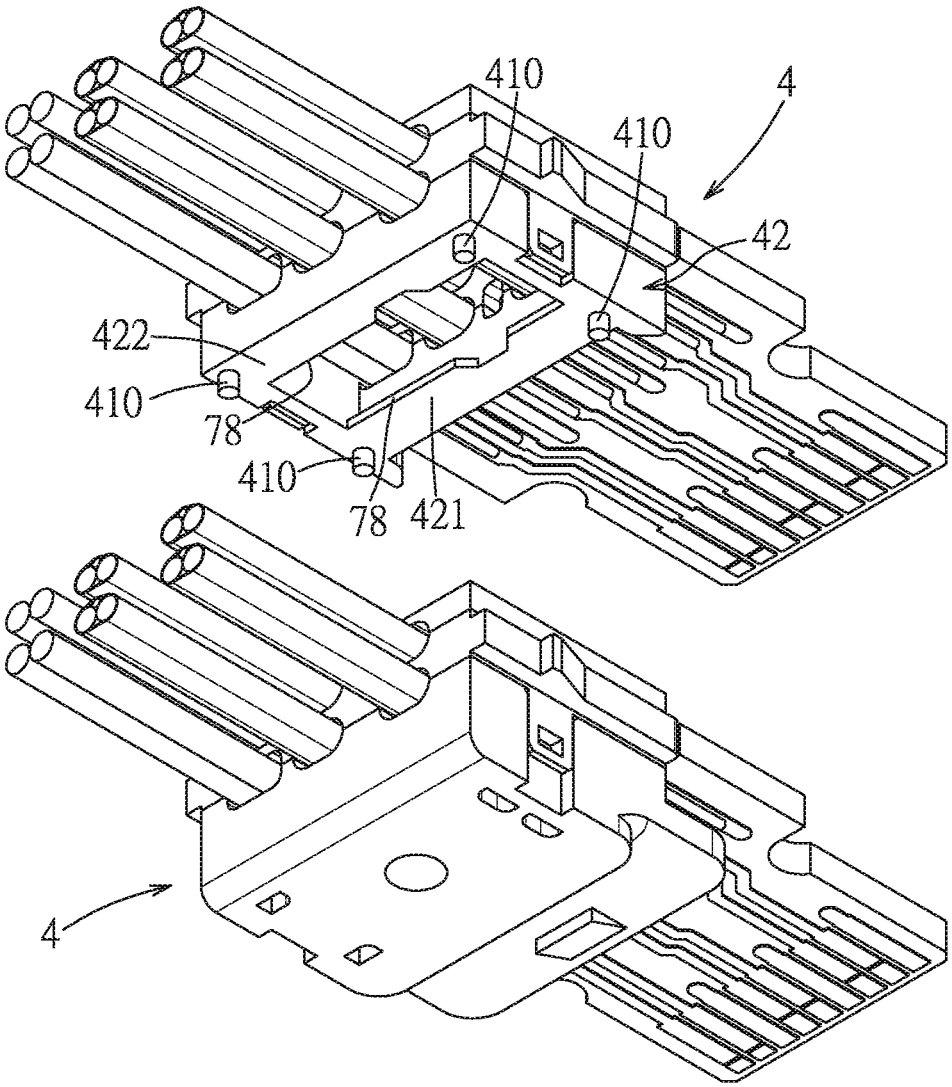
FIG. 41 is a perspective view illustrating that the another organizer of the second embodiment is provided with a plurality of positioning posts.
Figure 42:
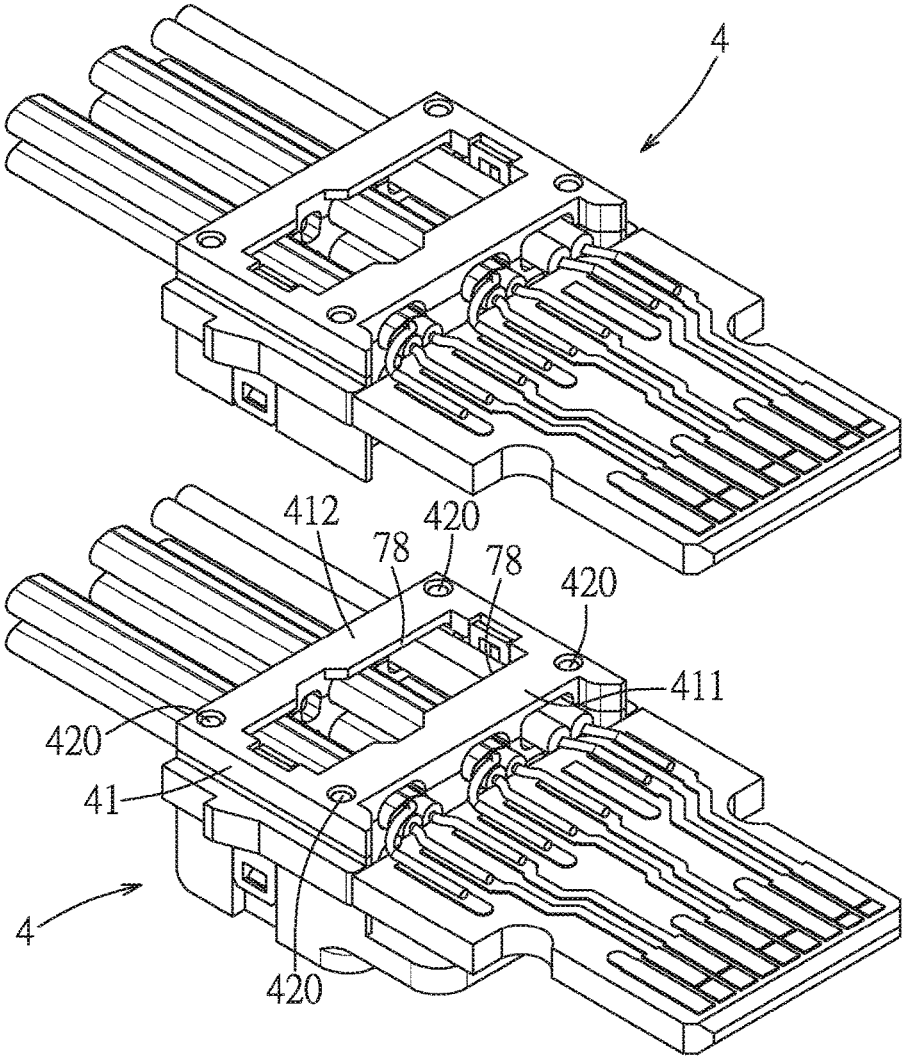
FIG. 42 is a perspective view illustrating that the another organizer of the second embodiment is provided with a plurality of positioning holes.

In addition, referring to FIG. 41 and FIG. 42, the second embodiment is further different from the first embodiment in that: during assembling, in the second embodiment, the two organizers 4 are stacked along the vertical direction, and a bottom portion of the lower cap 42 of the organizer 4 positioned above is provided with four positioning posts 410, and a top portion of the upper cap 41 of the organizer 4 positioned below is provided with four positioning holes 420 respectively cooperate with the positioning posts 410, by that the positioning posts 410 are respectively latched with the positioning holes 420, so as to position the two organizers 4 relative to each other. Of course, the positioning posts 410 and the positioning holes 420 are not limited to this in number.

Figure 43:
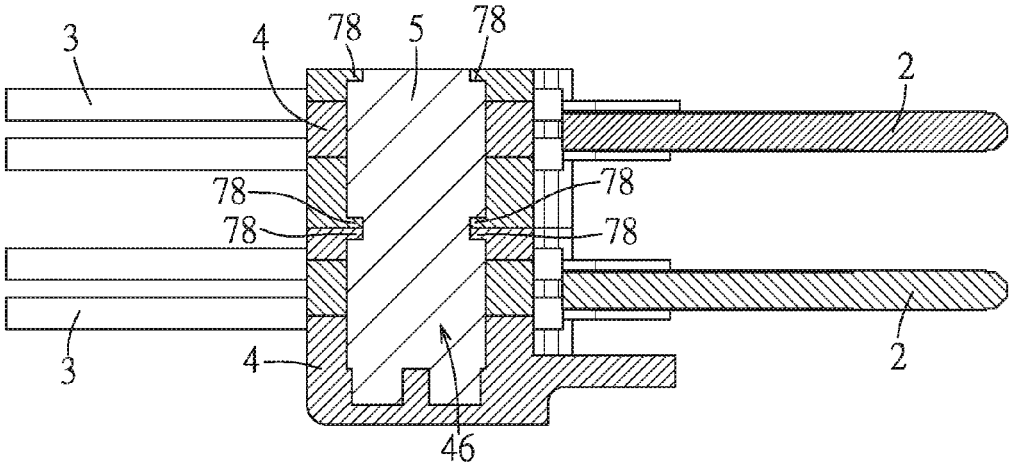
FIG. 43 is a cross sectional view taken along a line IVXIII-IVXIII of FIG. 35 and illustrating that a plurality of rib portions of the two organizers of the second embodiment are stacked with each other.

In addition, in combination with referring to FIG. 43, it should be especially noted that, when the two organizers 4 are stacked along the vertical direction, rib portions 78 positioned at the front frame portion 421 and the rear frame portion 422 of the lower cap 42 of the organizer 4 positioned above are respectively stacked with rib portions 78 positioned at the front frame portion 411 and the rear frame portion 412 of the upper cap 41 of the organizer 4 positioned below. As such, a binding material 5 can enclose the rib portions 78 stacked with each other, so as to allow the two organizers 4 to be tightly engaged together.

Figure 44:
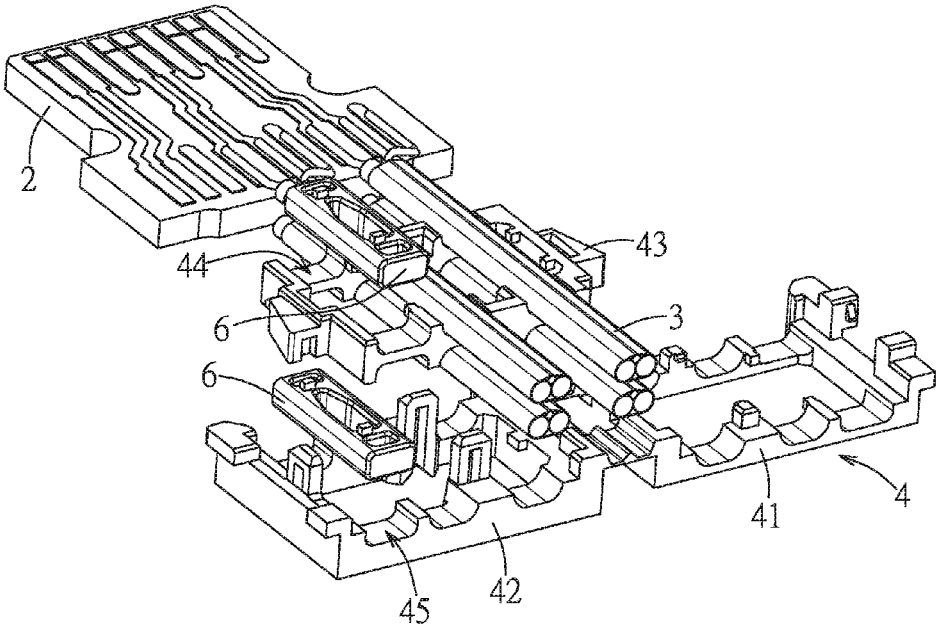
FIG. 44 is an exploded perspective view illustrating a plurality of insert pieces of a third embodiment of the cable connector.
Figure 45:
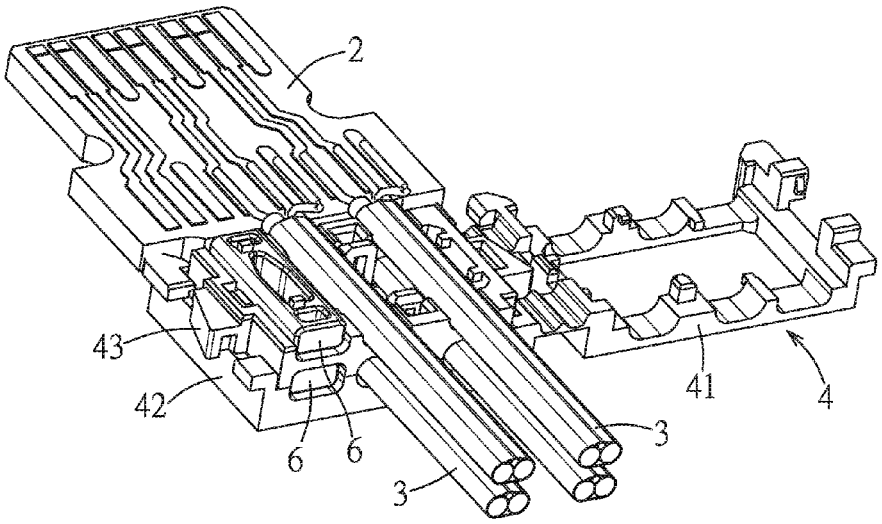
FIG. 45 is a perspective view illustrating a process that each insert piece of the third embodiment is inserted into one of a plurality of upper cable passages and a plurality of lower cable passages along a front-rear direction.
Figure 46:
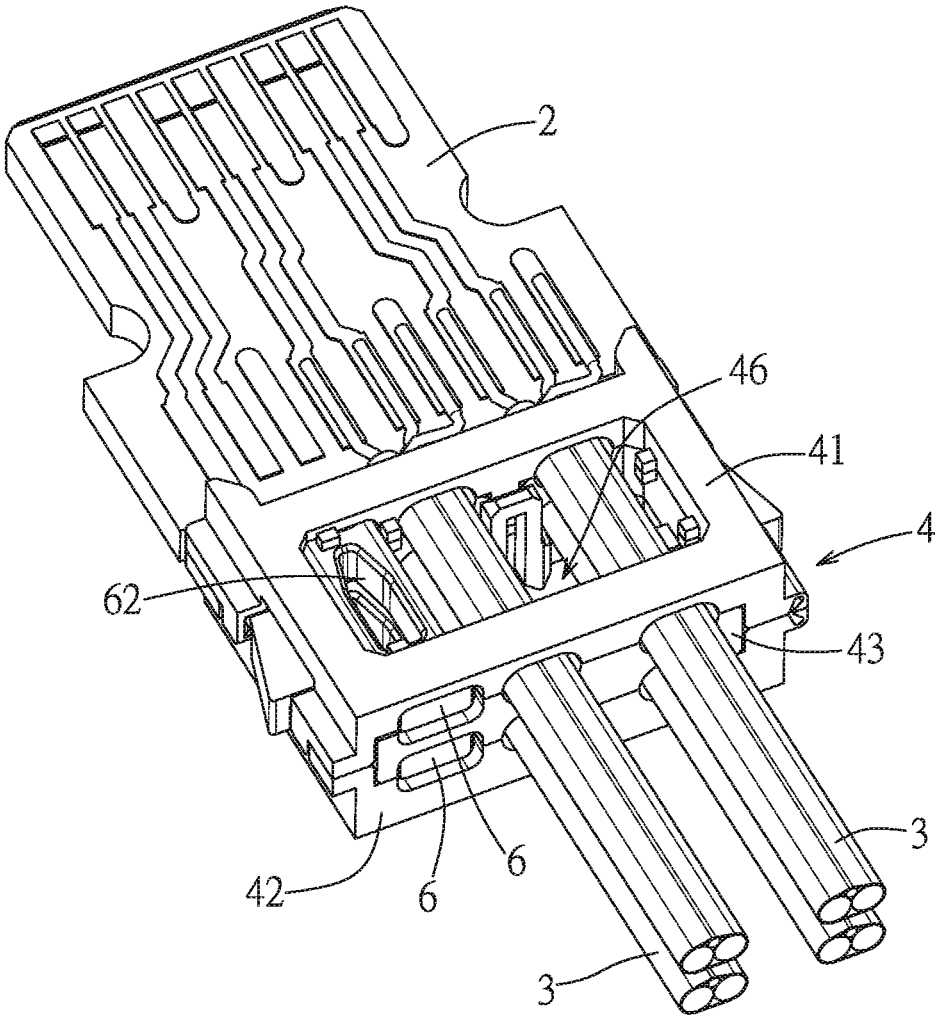
FIG. 46 is a perspective view illustrating that each insert piece of the third embodiment is inserted into one of the upper cable passages and the lower cable passages along the front-rear direction.

Referring to FIG. 44, FIG. 45 and FIG. 46, a third embodiment of a cable connector is substantially the same as the first embodiment in main structure, however, the third embodiment further comprises a plurality of insert pieces 6, each insert piece 6 is inserted into one of upper cable passages 44 and lower cable passages 45 of an organizer 4 along a front-rear direction. It should be noted that, when cables 3 used in the cable connector is fewer in number, some of the upper cable passages 44 or the lower cable passages 45 each do not receive the cable 3, the insert piece 6 may be is inserted into the organizer 4, so as to prevent the binding material 5 (see FIG. 43) from flowing out from the upper cable passage 44 which does not receive the cable 3or the lower cable passage 45 which does not receive the cable 3.

Figure 47:
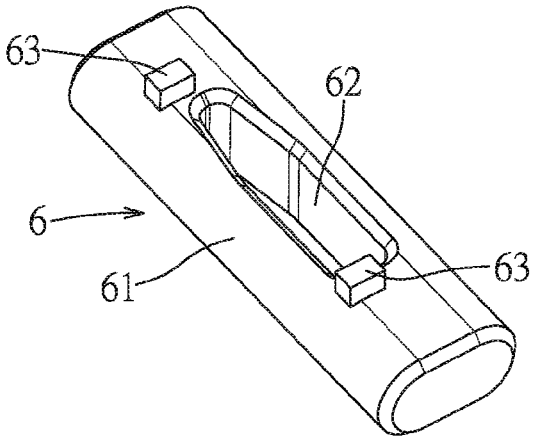
FIG. 47 is a perspective view illustrating a detailed structure of the insert piece of the third embodiment.
Figure 48:
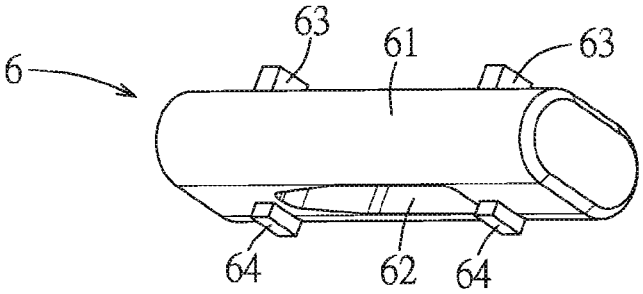
FIG. 48 is a perspective view illustrating the detailed structure of the insert piece of the third embodiment viewed from another angle.

Referring to FIG. 46, FIG. 47 and FIG. 48, each insert piece 6 comprises a main body 61, a filled hole 62, two first positioning portions 63 and two second positioning portions 64. The filled hole 62 is formed to the main body 61, passes through the main body 61 along a vertical direction, and is communicated with the filling space 46.The two first positioning portions 63 respectively protrude upwardly from a top surface of the main body 61 and are spaced apart from each other along the front-rear direction, and the two second positioning portions 64 respectively protrude downwardly from a bottom surface of the main body 61 and are spaced apart from each other along the front-rear direction, and the two first positioning portions 63 of each insert piece 6 respectively offset from the two second positioning portions 64 in the vertical direction.

Figure 49:
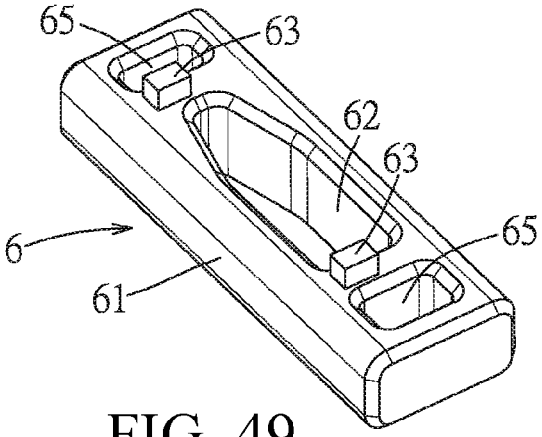
FIG. 49 is a perspective view illustrating a detailed structure of another insert piece of the third embodiment.

Referring to FIG. 49, in an embodiment, each insert piece 6 may further comprise two through holes 65, the two through holes 65 are respectively formed to the main body 61 and pass through the main body 61 along the vertical direction, and the two through holes 65 respectively are positioned at two sides of the filled hole 62 along the front-rear direction, the two through holes 65 can be further filled by the binding material 5.

Figure 50:
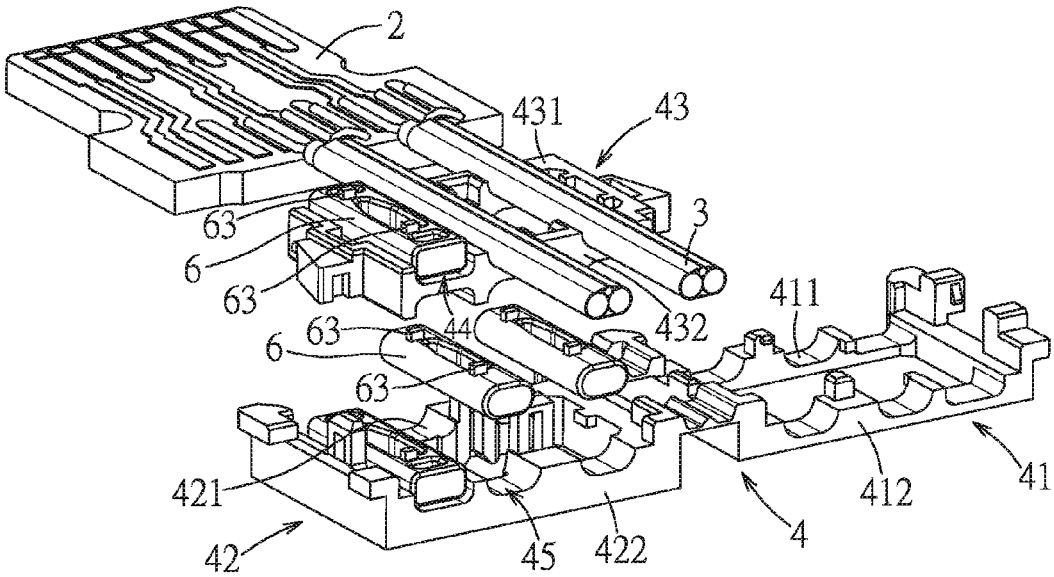
FIG. 50 is a perspective view illustrating that the insert pieces of the third embodiment are respectively inserted into the upper cable passages and the lower cable passages.

In combination with referring to FIG. 50, when the insert piece 6 is inserted into the corresponding upper cable passage 44, the two first positioning portions 63 are respectively stopped on an inner side of a front frame portion 411 of an upper cap 41 and an inner side of a rear frame portion 412 of the upper cap 41, and the two second positioning portions 64 are respectively stopped on an inner side of a front frame portion 431 of a spacer 43 and an inner side of a rear frame portion 432 of the spacer 43; when the insert piece 6 is inserted into the lower cable passage 45, the two first positioning portions 63 are respectively stopped on an inner side of a front frame portion 431 of the spacer 43 and an inner side of a rear frame portion 432 of the spacer 43, and the two second positioning portions 64 are respectively stopped on an inner side of a front frame portion 421 of a lower cap 42 and an inner side of a rear frame portion 422 of the lower cap 42. As such, during assembling, each insert piece 6 can be positioned into the corresponding upper cable passage 44 or the lower cable passage 45 via the first positioning portions 63 and the second positioning portions 64. Moreover, the filled hole 62 and the filling space 46 are communicated with each other, the binding material 5 (see FIG. 43) can smoothly fill the whole interior of the organizer 4, so as to attain the effect that the cables 3 are fixed to the organizer 4.

Figure 51:
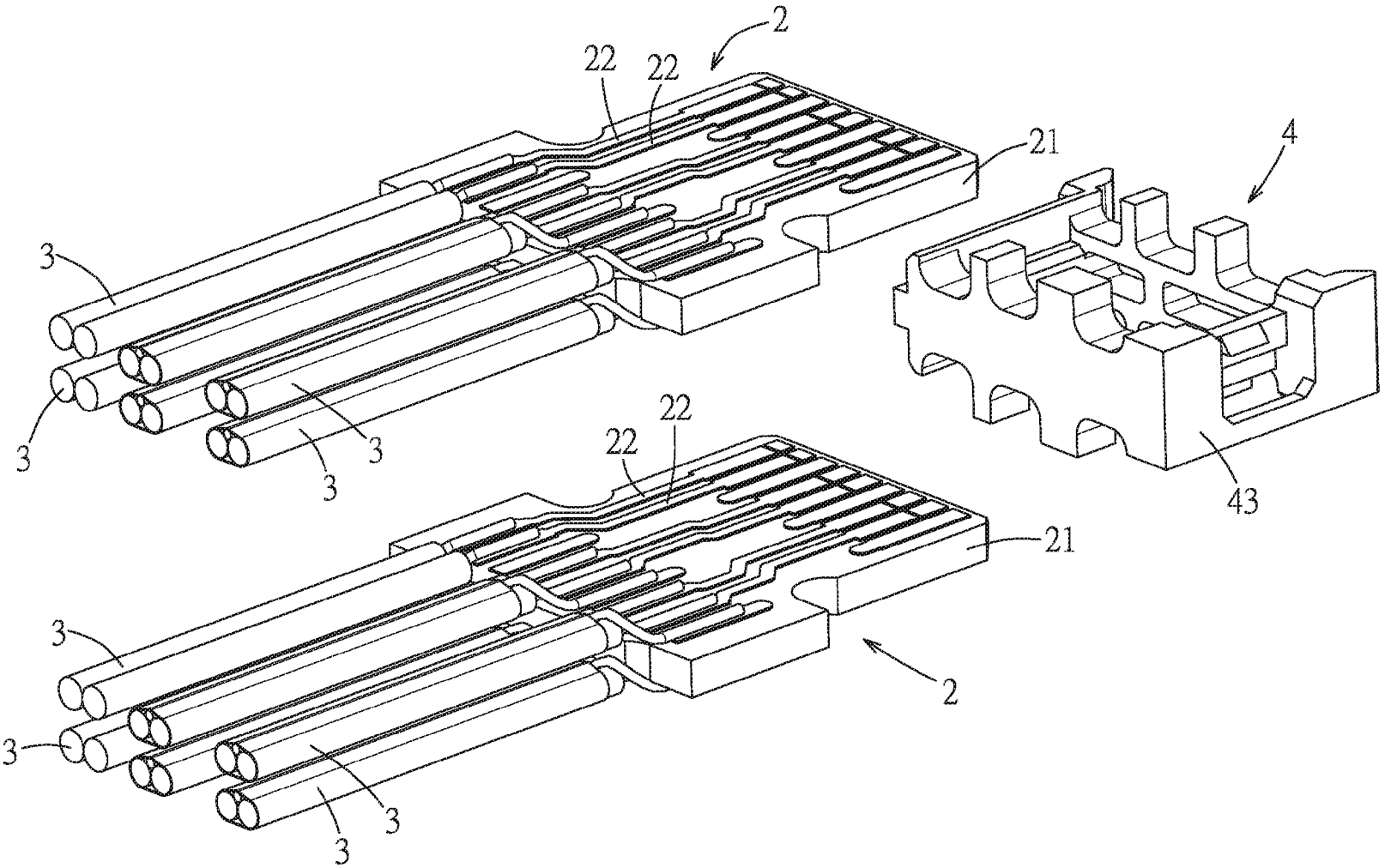
FIG. 51 is a perspective view illustrating a fourth embodiment of the cable connector.
Figure 52:
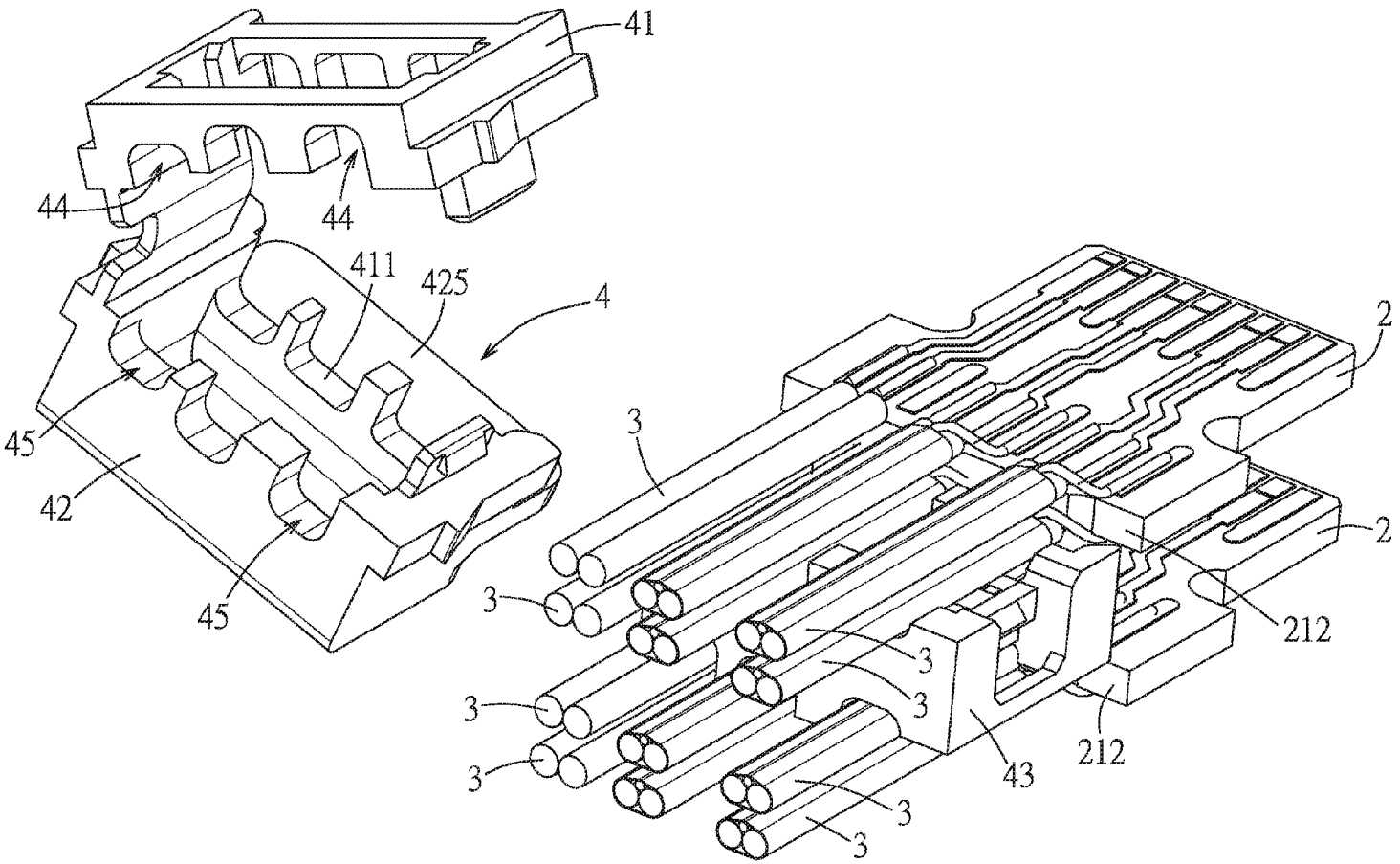
FIG. 52 is a perspective view illustrating a spacer of an organizer of the fourth embodiment is inserted between a plurality of cables.
Figure 53:
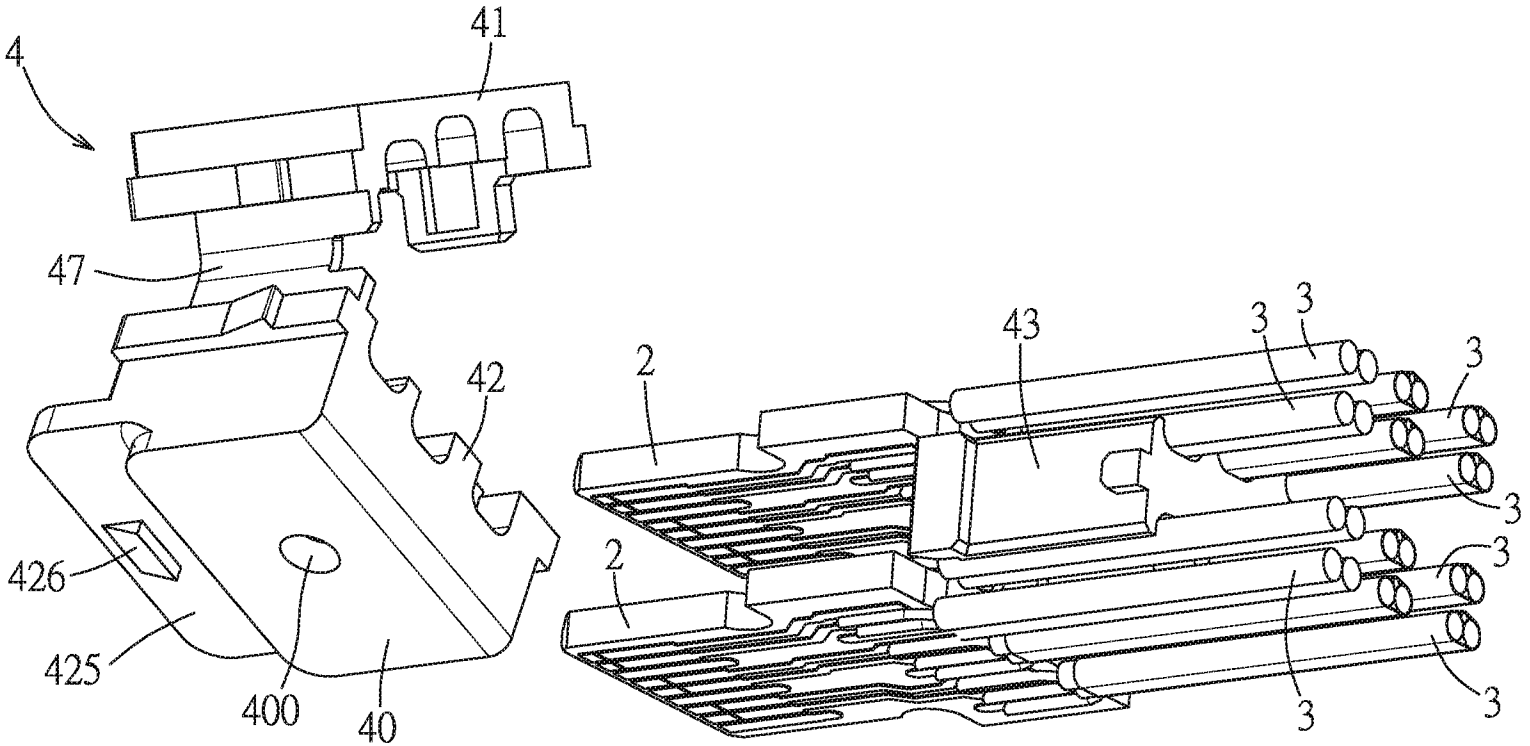
FIG. 53 is a perspective view illustrating the spacer of the organizer of the fourth embodiment is inserted between the cables and viewed from another angle.
Figure 54:
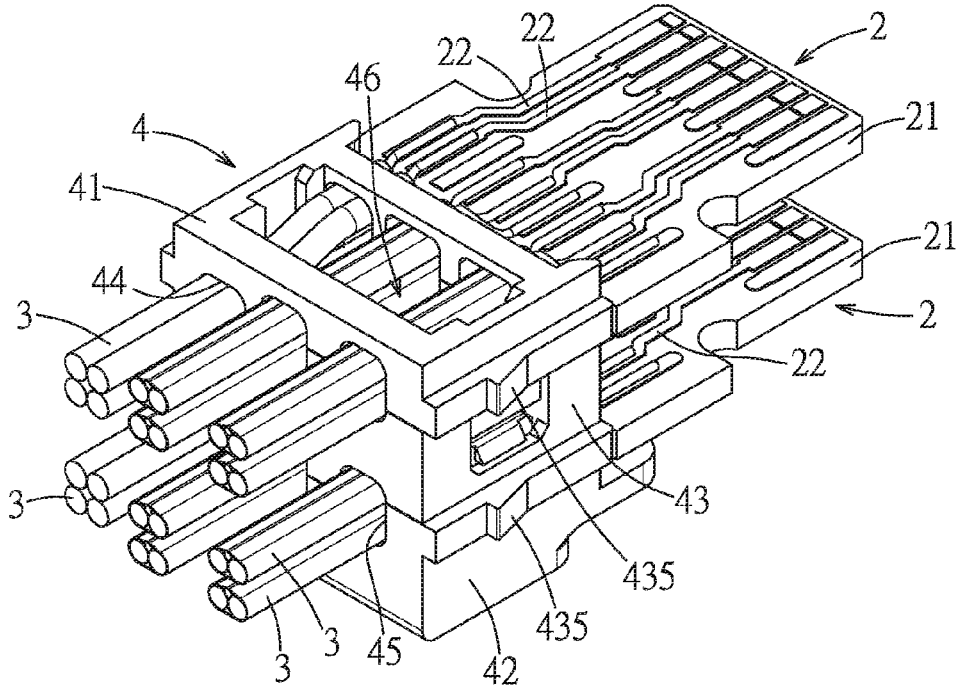
FIG. 54 is a perspective view illustrating an assembled state of the fourth embodiment.
Figure 55:
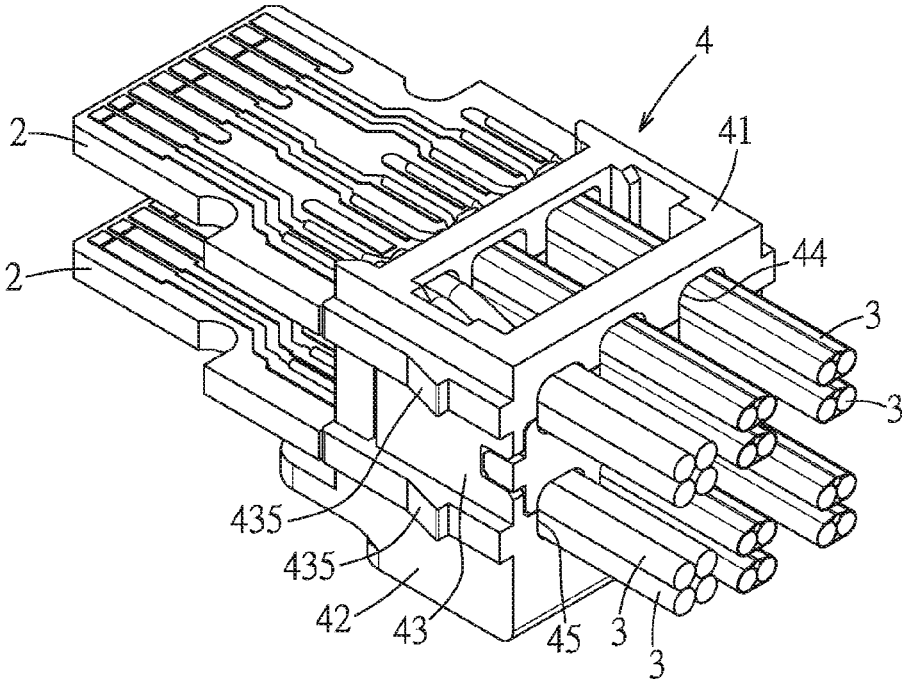
FIG. 55 is a perspective view illustrating the assembled state of the fourth embodiment viewed from another angle.
Figure 56:
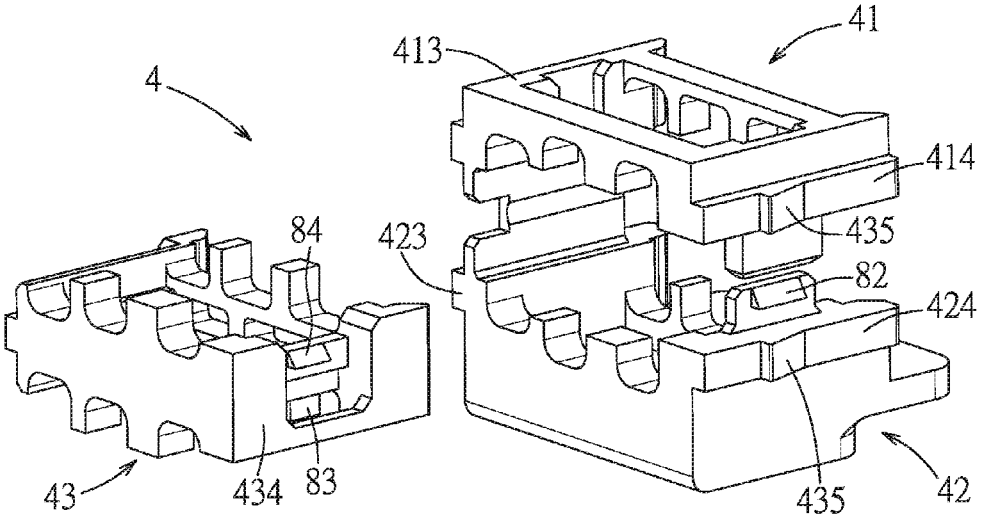
FIG. 56 is a perspective view illustrating an exploded structure of the organizer of the fourth embodiment.
Figure 57:
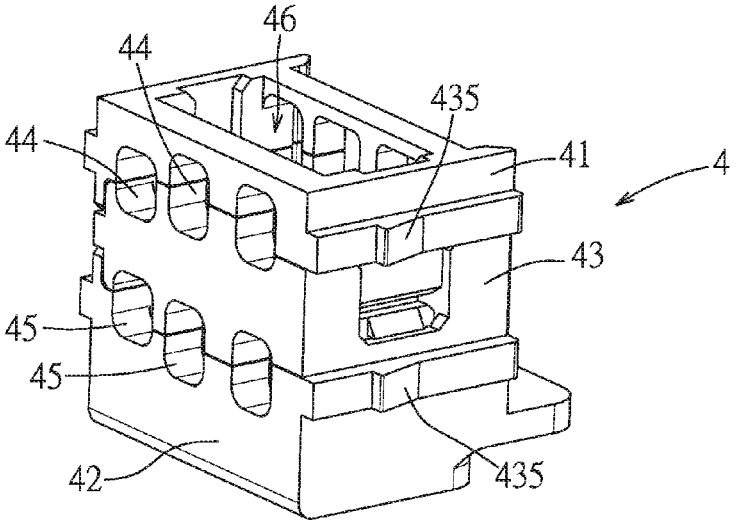
FIG. 57 is a perspective view illustrating an assembled structure of the organizer of the fourth embodiment.
Figure 58:
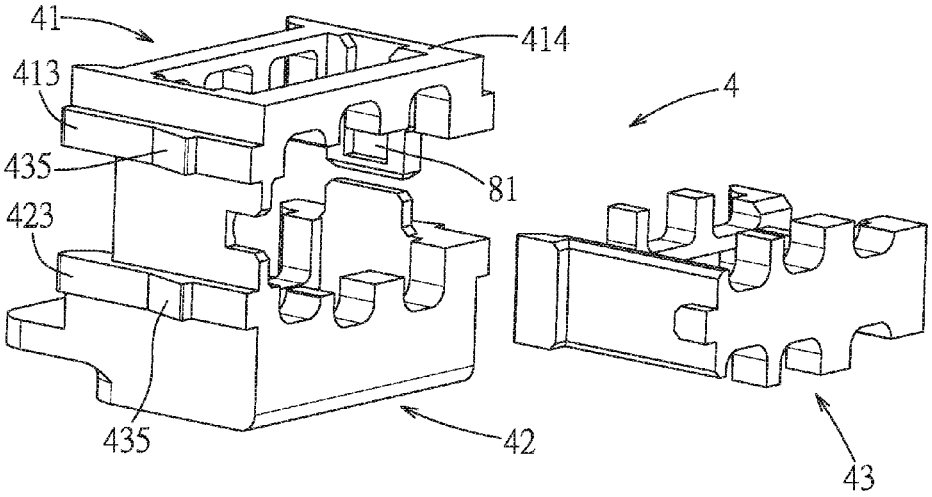
FIG. 58 is a perspective view illustrating the exploded structure of the organizer of the fourth embodiment viewed from another angle.
Figure 59:
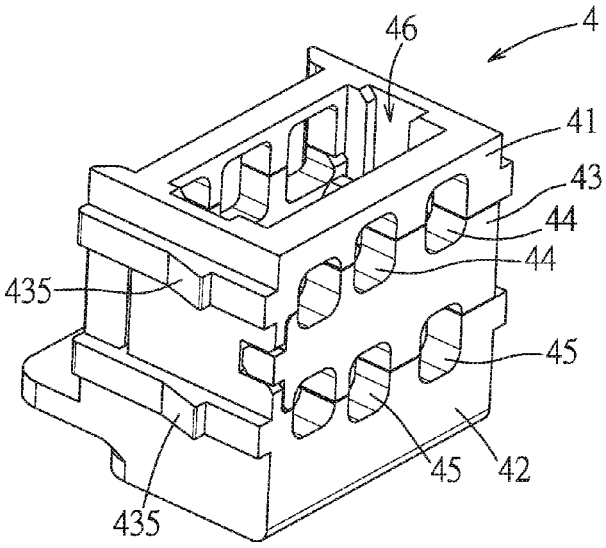
FIG. 59 is a perspective view illustrating the assembled structure of the organizer of the fourth embodiment viewed from another angle.

Referring to FIG. 51, FIG. 52 and FIG. 53, a fourth embodiment of the present disclosure cable connector is substantially the same as the first embodiment in main structure, however, the fourth embodiment comprises an organizer 4, a lower cap 42 of the organizer 4 has an extension plate 425 which extends forwardly from a front frame portion 411 and a third latching portion 426 which is formed on a bottom side of the extension plate 425, and the organizer 4 further comprises a bottom plate 40 provided to the lower cap 42, the bottom plate 40 is further formed with an injection hole 400. In combination with referring to FIG. 54 and FIG. 55, two mating boards 2 are arranged to space apart from each other along a vertical direction, cables 3 respectively electrically connected to conductive portions 22 of a board body 21 positioned above are respectively received in upper cable passages 44, cables 3 respectively electrically connected to conductive portions 22 of a board body 21 positioned below are respectively received in lower cable passages 45.

Referring to FIG. 56 to FIG. 59, an upper cap 41 and the lower cap 42 of the organizer 4 are integrally formed, a first side frame portion 413 of the upper cap 41 and a first side frame portion 423 of the lower cap 42 are connected by a connecting portion 47 (see FIG. 53) which is flexible, and a second side frame portion 414 of the upper cap 41 is formed with a latching groove 81 (see FIG. 58), a second side frame portion 424 of the lower cap 42 is formed with a first locking catch 82, and a second side frame portion 434 of a spacer 43 is formed with a second locking catch 84 which cooperates with the latching groove 81 and a latching hole 83 which cooperates with the first locking catch 82, by that the second locking catch 84 is correspondingly latched into the latching groove 81, the spacer 43 and the upper cap 41 are engaged with each other, further by that the latching hole 83 is correspondingly latched with the first locking catch 82, the spacer 43 and the lower cap 42 are engaged with each other. It should be emphasized that, first latching portions 435 are respectively provided to the first side frame portion 413 and the second side frame portion 414 of the upper cap 41 and the first side frame portion 423 of the second side frame portion 424 of the lower cap 42.

Figure 60:
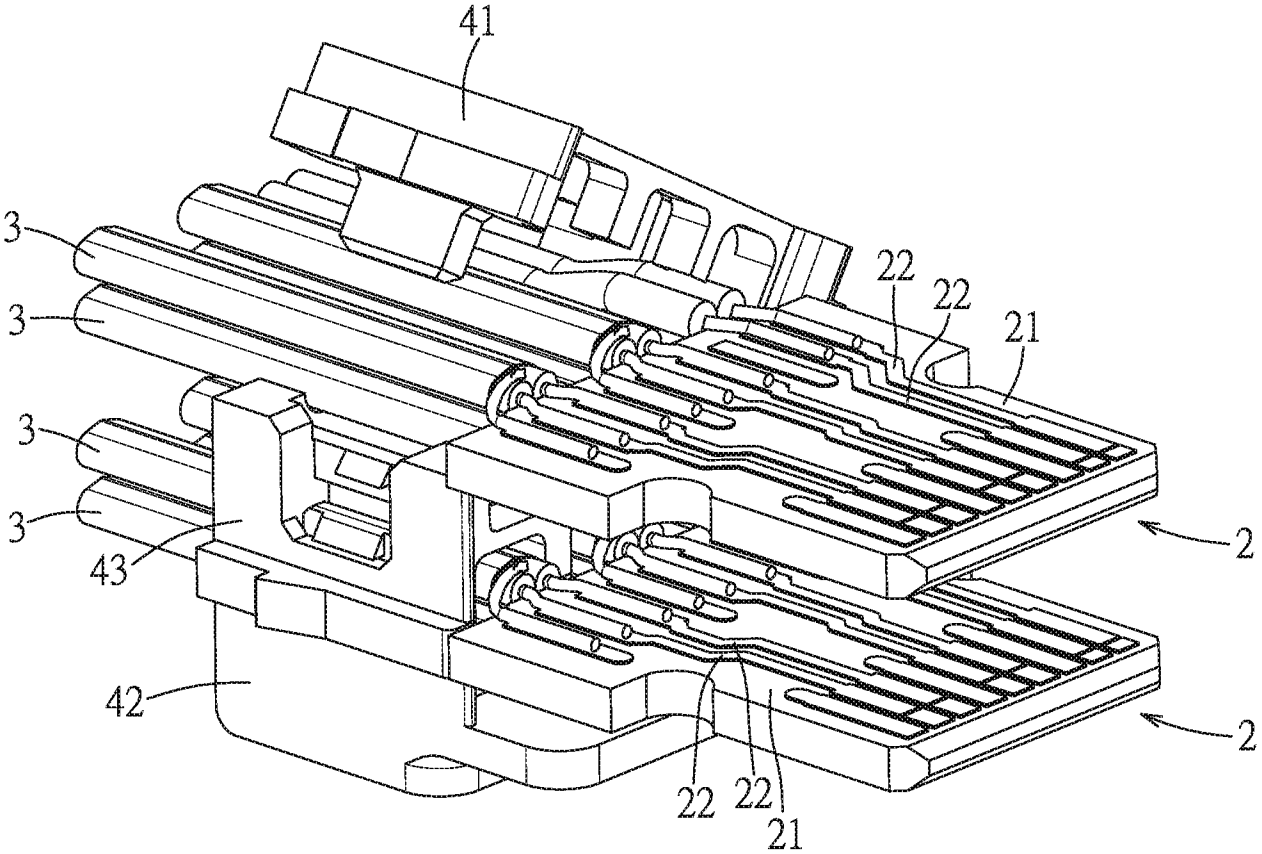
FIG. 60 is a perspective view illustrating an assembling process of the fourth embodiment.
Figure 61:
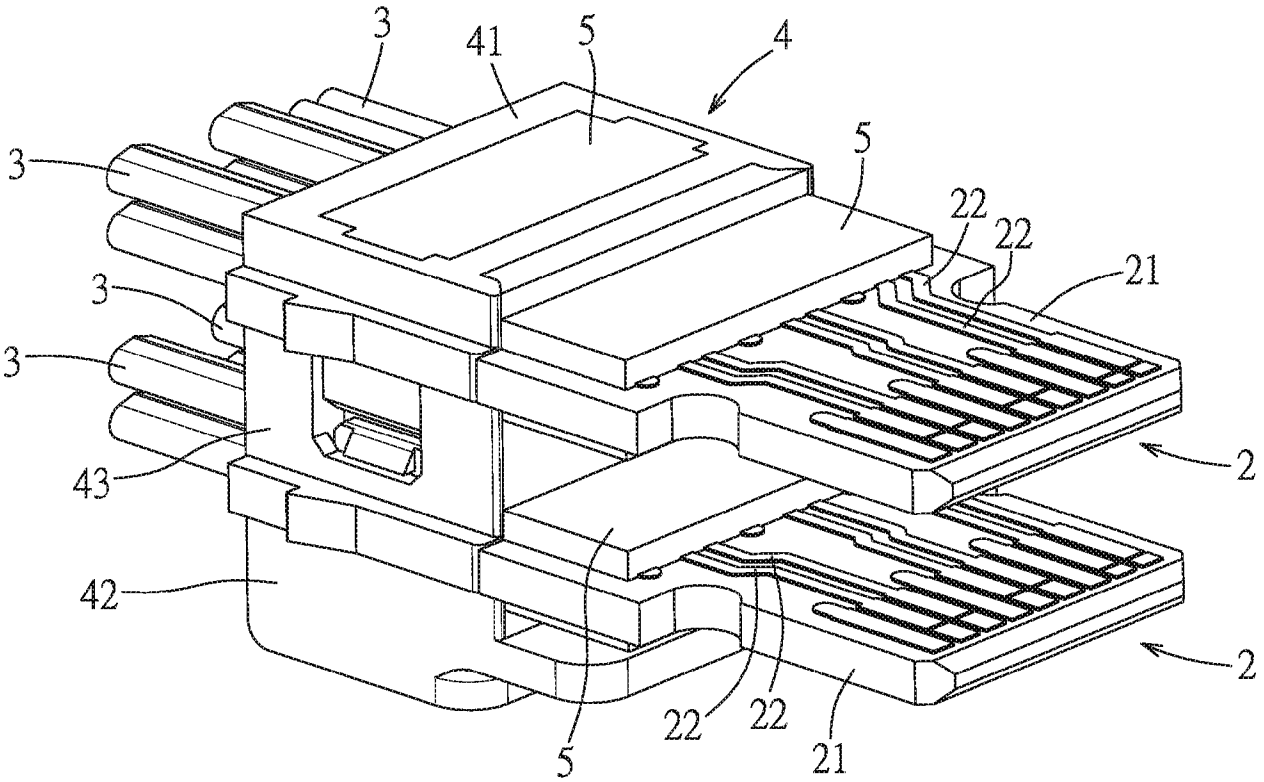
FIG. 61 is a perspective view illustrating that a binding material of the fourth embodiment extends to a partial region of two mating boards from a filling space.

Referring to FIG. 52 and FIG. 60, during assembling, first the spacer 43 of the organizer 4 is inserted between the cables 3 which are connected to the two mating boards 2, and then the spacer 43 is pushed toward rear edges 212 of the two mating boards 2, next the upper cap 41 and the lower cap 42 respectively cover a top portion and a bottom portion of the spacer 43, so as to allow the organizer 4 to interpose and comb the cables 3, and in turn allow the cables 3 to be separated from each other. In combination with referring to FIG. 54 and FIG. 61, then the binding material 5 is filled in the whole filling space 46, and the binding material 5 further extends to a partial region of the two mating boards 2, so as to cover and protect the conductive portions 22 (as shown in FIG. 61).

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

What is claimed is:

1. A cable connector, comprising:

at least one mating board, the mating board comprising a board body having a front edge and a rear edge and a plurality of conductive portions provided on the board body;

a plurality of cables respectively electrically connected to the conductive portions and extending from the rear edge;

at least one organizer, the organizer comprising an upper cap, a lower cap and a spacer interposed between the upper cap and the lower cap, the upper cap, the lower cap and the spacer each being frame-shaped and each having a front frame portion, a rear frame portion spaced apart from and opposite to the front frame portion, and a first side frame portion and a second side frame portion each connecting the front frame portion and the rear frame portion and spaced apart from each other and opposite to each other, and the upper cap, the lower cap and the spacer cooperatively defining a filling space, the spacer and the upper cap cooperatively defining a plurality of upper cable passages respectively extending along a front-rear direction and respectively receiving the cables and the spacer and the lower cap cooperatively defining a plurality of lower cable passages respectively extending along the front-rear direction and respectively receiving the cables, so as to allow the plurality of cables to pass through the filling space; and a binding material provided in the filling space of the organizer, the binding material fixing the plurality of cables to the organizer.

2. The cable connector according to claim 1, wherein the mating board is a first mating board and the organizer is a first organizer, the connector further including a second mating board and a second organizer, the first and second organizers respectively supporting the cables of the first and second mating boards; the first and second two organizers being stacked in a vertical direction and the two filling spaces being in communication with each other.

3. The cable connector according to claim 1, wherein the organizer further comprises a connecting portion which is flexible and connects the first side frame portion of the upper cap and the first side frame portion of the lower cap.

4. The cable connector according to claim 3, wherein the connecting portion of the organizer has a strip body whose two long side edges respectively connect the first side frame portion of the upper cap and the first side frame portion of the lower cap and a protruding rib which protrudes from a surface of the strip body toward the inside of the organizer, the protruding rib extends parallel to the two long side edge of the strip body, is positioned in the middle of the strip body and bulges from two sides respectively close to the two long side edges toward the middle of the strip body so as to have a general triangle in cross section.

5. The cable connector according to claim 3, wherein the spacer of the organizer further has two first latching portions respectively provided to the first side frame portion and the second side frame portion of the spacer, the two first latching portions each is a latching block;

the first side frame portion of the upper cap and the first side frame portion of the lower cap cooperatively define a first entrance opening, and the second side frame portion of the upper cap and the second side frame portion of the lower cap cooperatively define a second entrance opening, the first entrance opening and the second entrance opening respectively allow the two first latching portions of the spacer to extend through; and a top surface of the first latching portion positioned at the first side frame portion of the spacer is formed with a recessed groove, the first side frame portion of the upper cap is formed with a protrusion latched into the recessed groove.

6. The cable connector according to claim 5, wherein the two first latching portions of the spacer of the organizer each have a front side surface, a rear side surface and an outer side surface connecting the front side surface and the rear side surface, the rear side surface further protrudes outwardly relative to the front side surface so as to allow the outer side surface to be oblique inwardly from the rear to the front, the front side surface and the rear side surface of the first latching portion positioned at the second side frame portion of the spacer each are formed with a stopping block; and the second side frame portion of the upper cap is formed with two inner side surfaces which face each other and face the second entrance opening, two protruding blocks respectively protrude from the two inner side surfaces to respectively latch with the two stopping blocks.

7. The cable connector according to claim 3, wherein the lower cap of the organizer further has three latching frames, the three latching frames are respectively formed to an inner side of the second side frame portion of the lower cap, an inner side of the front frame portion of the lower cap and an inner side of the rear frame portion of the lower cap;

the second side frame portion, the front frame portion and the rear frame portion of the spacer and the front frame portion and the rear frame portion of the upper cap each further are formed with a latching block protruding toward the filling space;

the latching block of the second side frame portion of the spacer is latched with the latching frame positioned at the second side frame portion of the lower cap from outside to inside;

the latching block of the front frame portion of the upper cap and the latching block of the front frame portion of the spacer are stacked with each other and at the same time together are latched with the latching frame positioned at the front frame portion of the lower cap from outside to inside;

the latching block of the rear frame portion of the upper cap and the latching block of the rear frame portion of the spacer are stacked with each other and at the same time together are latched with the latching frame positioned at the rear frame portion of the lower cap from outside to inside.

8. The cable connector according to claim 3, wherein the organizer further has a plurality of protruding portions protruding toward the filling space, the protruding portions are respectively positioned at the upper cap, the spacer and the lower cap.

9. The cable connector according to claim 8, wherein at least some of protruding portions of the organizer may be stacked with each other.

10. The cable connector according to claim 2, wherein one of the two organizers is provided with a plurality of positioning posts, the other of the two organizers is provided with a plurality of positioning holes which respectively cooperate with the positioning posts so as to position the two organizers relative to each other.

11. The cable connector according to claims 1, wherein the upper cap and the spacer of the organizer are stacked along the vertical direction, and the upper cap is provided with a plurality of first snapping portions, the spacer is provided with a plurality of second snapping portions which respectively cooperate with the first snapping portions so as to position the upper cap and the spacer relative to each other;

the spacer and the lower cap are stacked along the vertical direction, and the spacer is provided with a plurality of third snapping portions, the lower cap is provided with a plurality of fourth snapping portions which respectively cooperate with the third snapping portions so as to position the spacer and the lower cap relative to each other.

12. The cable connector according to claim 11, wherein each first snapping portion of the upper cap of the organizer is a protruding post or a recessed hole, each second snapping portion of the spacer of the organizer is a recessed hole or a protruding post, the upper cap and the spacer are connected together by correspondingly engaging the protruding posts with the recessed holes;

each third snapping portion of the spacer is a protruding post or a recessed hole, each fourth snapping portion of the lower cap is a recessed hole or a protruding post, the spacer and the lower cap are connected together by correspondingly engaging the protruding posts with the recessed holes.

13. The cable connector according to claim 11, wherein the spacer of the organizer further has two latching frames respectively extending upwardly from the first side frame portion of the spacer and the second side frame portion of the spacer, an inner side of the first side frame portion of the upper cap and an inner side of the second side frame portion of the upper cap are respectively formed with two latching blocks which protrude toward the filling space and are respectively latched from outside to inside with the two latching frames extending upwardly, so as to allow the upper cap and the spacer to be engaged with each other; and the spacer further has two latching frames respectively extending downwardly from the first side frame portion of the spacer and the second side frame portion of the spacer, an outer side of the first side frame portion of the lower cap and an outer side of the second side frame portion of the lower cap are respectively formed with two latching blocks which protrude toward a direction away from the filling space and are respectively latched from inside to outside with the two latching frames extending downwardly, so as to allow the lower cap and the spacer to be engaged with each other.

14. The cable connector according to claim 11, wherein the front frame portion and the rear frame portion of the upper cap of the organizer respectively cooperate with and the front frame portion and the rear frame portion of the spacer to define two first blind holes opened toward the filling space;

the front frame portion and the rear frame portion of the lower cap respectively cooperate with the front frame portion and the rear frame portion of the spacer to define two second blind holes opened toward the filling space; and the two first blind holes and the two second blind holes each are a structure which is narrow at the opened position and wide at the inside and is in communication with the filling space.

15. The cable connector according to 14, wherein the first blind holes and the second blind holes of the organizer each are formed by two blind grooves.

16. The cable connector according to claim 11, wherein the organizer further has a plurality of rib portions protruding toward the filling space, and the rib portions are respectively positioned the upper cap, the lower cap and the spacer.

17. The cable connector according to claim 16, wherein the organizer is provided as two in number, when the two organizers are stacked along the vertical direction, the rib portions of the lower cap of the organizer positioned above are respectively stacked with the rib portions of the upper cap of the organizer positioned below.

18. The cable connector according to claims 1, further comprising a plurality of insert pieces, each insert piece being inserted into one of the upper cable passages and the lower cable passages along the front-rear direction.

19. The cable connector according to claim 18, wherein each insert piece comprises a main body and a filled hole formed to the main body and passing through the main body along the vertical direction, the filled hole is communicated with the filling space.

20. The cable connector according to 19, wherein each insert piece further comprises two first positioning portions respectively protruding upwardly from a top surface of the main body and spaced apart from each other along the front-rear direction, wherein the insert piece is inserted into the corresponding upper cable passage so that the two first positioning portions are respectively stopped on an inner side of the front frame portion of the upper cap and an inner side of the rear frame portion of the upper cap and the insert piece is inserted into the corresponding lower cable passage so that the two first positioning portions are respectively stopped on an inner side of the front frame portion of the spacer and an inner side of the rear frame portion of the spacer.

21. The cable connector according to claim 20, wherein each insert piece further comprises two second positioning portions respectively protruding downwardly from a bottom surface of the main body and spaced apart from each other along the front-rear direction, wherein the insert piece is inserted into the corresponding upper cable passage so that the two second positioning portions are respectively stopped on the inner side of the front frame portion of the spacer and the inner side of rear frame portion of the spacer and the insert piece is inserted into the corresponding lower cable passage so that the two second positioning portions are respectively stopped on an inner side of the front frame portion of the lower cap and an inner side of the rear frame portion of the lower cap.

22. The cable connector according to claim 21, wherein the two first positioning portions are respectively offset from the two second positioning portions along the vertical direction in each insert piece.

23. The cable connector according to claim 22, wherein each insert piece further comprises two through holes respectively formed to the main body and passing through the main body along the vertical direction, the two through holes are respectively positioned at two sides of the filled hole along the front-rear direction.

24. The cable connector according to claim 1, wherein the mating board is a first mating board, the cable connector further including a second mating board and the organizer is a single organizer, the upper cable passages of the organizer are used to receive the cables on first mating board, the lower cable passages are used to receive the cables on the second mating board.

25. The cable connector according to claim 24, wherein the upper cap and the lower cap of the organizer are integrally formed, the first side frame portion of the upper cap and the first side frame portion of the lower cap are connected by a connecting portion which is flexible, the second side frame portion of the upper cap is formed with a latching groove, the second side frame portion of the lower cap is formed with a first locking catch and the second side frame portion of the spacer is formed with a second locking catch which is correspondingly latched with the latching groove of the upper cap and a latching hole which is correspondingly latched with the first locking catch of the lower cap.

26. The cable connector according to claim 24, wherein the cable connector further comprises a housing, the housing has a front side, a rear side and a mating port positioned at the front side, the mating board and the organizer are provided in the housing, and the cables respectively extend through the rear side of the housing and extend outwardly and the upper cap and the lower cap of the organizer each further have two first latching portions which are respectively provided to the first side frame portion and the second side frame portion and the housing further has two side walls which are spaced apart from and opposite to each other and are positioned on the left side and the right side and four second latching portions which are correspondingly formed on the two side walls and respectively cooperate with the four first latching portions and when the four first latching portions are respectively latched with the four second latching portions, the organizer is positioned in the housing.

27. The cable connector according to claims 1, wherein the binding material extends to the mating board from the filling space.

28. The cable connector according to claim 2, wherein the cable connector further comprises a housing, the housing having a front side, a rear side and a mating port positioned at the front side, the mating board and the organizer are provided in the housing, and the cables respectively extend through the rear side of the housing and extend outwardly and the spacer of the organizer further has two first latching portions respectively provided to the first side frame portion and the second side frame portion of the spacer and the housing further has two side walls which are spaced apart from and opposite to each other and are respectively positioned on the left side and the right side and two second latching portions which are respectively formed to the two side walls and are respectively cooperate with the two first latching portions, wherein when the two first latching portions are respectively latched with the two second latching portions, the organizer is positioned in the housing.

29. The cable connector according to claim 28, wherein the lower cap of the organizer positioned below further has an extension plate extending forwardly from the front frame portion the lower cap of the organizer positioned below and a third latching portion formed on a bottom side of the extension plate the housing further has a bottom wall connecting the two side walls and a fourth latching portion formed on the bottom wall and cooperating with the third latching portion by that the third latching portion and the fourth latching portion are latched with each other, the organizer positioned below is positioned in the housing.

* * * * *